US011519149B2

(12) United States Patent
Kitamura et al.

(10) Patent No.: US 11,519,149 B2
(45) Date of Patent: Dec. 6, 2022

(54) PILE JOINT, PILE COUPLING STRUCTURE, AND PILE COUPLING METHOD

(71) Applicant: GIKEN LTD., Kochi (JP)

(72) Inventors: Akio Kitamura, Kochi (JP); Masahiko Yoshikawa, Kochi (JP)

(73) Assignee: GIKEN LTD., Kochi (JP)

( * ) Notice: Subject to any disclaimer, the term of this patent is extended or adjusted under 35 U.S.C. 154(b) by 0 days.

(21) Appl. No.: 17/429,772

(22) PCT Filed: Feb. 12, 2020

(86) PCT No.: PCT/JP2020/005338
§ 371 (c)(1),
(2) Date: Aug. 10, 2021

(87) PCT Pub. No.: WO2020/166607
PCT Pub. Date: Aug. 20, 2020

(65) Prior Publication Data

US 2022/0136200 A1 May 5, 2022

(30) Foreign Application Priority Data

Feb. 12, 2019 (JP) ..... JP2019-022622
Feb. 12, 2020 (JP) ..... JP2020-021278

(51) Int. Cl.
*E02D 5/52* (2006.01)

(52) U.S. Cl.
CPC ..... *E02D 5/526* (2013.01)

(58) Field of Classification Search
CPC ..... E02D 5/526; E04C 3/22; E04C 5/165
See application file for complete search history.

(56) References Cited

U.S. PATENT DOCUMENTS

2004/0076479 A1* 4/2004 Camilleri ..... E02D 5/56 405/252.1
2015/0071712 A1* 3/2015 Kemp ..... E02D 5/52 405/251

(Continued)

FOREIGN PATENT DOCUMENTS

AU 2014/358146 A1 4/2016
CN 101353893 A 1/2009

(Continued)

OTHER PUBLICATIONS

Office Action issued in corresponding Japanese Patent Application No. JP2020-021278 dated Oct. 6, 2020 (6 pages).

(Continued)

*Primary Examiner* — Carib A Oquendo
(74) *Attorney, Agent, or Firm* — Osha Bergman Watanabe & Burton LLP

(57) ABSTRACT

Provided are a pile joint, a pile coupling structure, and a pile coupling method that allow firm uniting of piles to be coupled. A joint (10) for coupling two piles (12) comprises: a tubular body (16) into which each pile (12) provided with a key (14) on a periphery thereof is inserted through an end (16A) of the body (16); and a fitting portion (22) formed on the body (16) so as to be fitted to the key (14) by the insertion and rotation of the pile (12). The fitting portion (22) is formed with: a tapered shape having a surface (22A) that is inclined so as to become distant from the end (16A) of the body (16) as the surface (22A) extends in the direction of rotation of the pile (12); or a wedge shape for fitting between a projection and a pile.

13 Claims, 18 Drawing Sheets

(a) (b)

(56) References Cited

U.S. PATENT DOCUMENTS

| | | | | |
|---|---|---|---|---|
| 2015/0259871 | A1 | 9/2015 | Ditillo et al. | |
| 2016/0230364 | A1* | 8/2016 | Stroyer | F16D 1/04 |
| 2017/0183837 | A1* | 6/2017 | Suzuki | E02D 5/523 |

FOREIGN PATENT DOCUMENTS

| | | | |
|---|---|---|---|
| JP | S60-195330 | U | 12/1985 |
| JP | S63-040088 | A | 2/1988 |
| JP | H04-122733 | U | 11/1992 |
| JP | H09-100534 | A | 4/1997 |
| JP | H09-287135 | A | 11/1997 |
| JP | H11-43937 | A | 2/1999 |
| JP | 2002-70048 | A | 3/2002 |
| JP | 2003-090034 | A | 3/2003 |
| JP | 3909566 | B2 | 4/2007 |
| JP | 2009-293343 | A | 12/2009 |
| JP | 2011-132702 | A | 7/2011 |
| JP | 2014-141800 | A | 8/2014 |
| JP | 2014-227688 | A | 12/2014 |
| JP | 2015-007338 | A | 1/2015 |
| JP | 2015-169061 | A | 9/2015 |
| JP | 2016-023520 | A | 2/2016 |
| JP | 2016-044476 | A | 4/2016 |
| JP | 2016-108847 | A | 6/2016 |
| JP | 2017-186795 | A | 10/2017 |
| JP | 2018-096187 | A | 6/2018 |
| JP | 2018-145630 | A | 9/2018 |
| KR | 2010-0024861 | A | 3/2010 |
| KR | 101913401 | B1 | 10/2018 |
| WO | 2011/046748 | A1 | 4/2011 |

OTHER PUBLICATIONS

Decision to Grant issued in corresponding Japanese Patent Application No. JP2020-021278 dated Feb. 16, 2021 (5 pages).
Office Action issued in corresponding Australian Patent Application No. 2020220777 dated Mar. 3, 2022 (10 pages).
Office Action issued in Chinese Application No. 202080013124.7 dated Apr. 12, 2022 (9 pages).
Office Action issued in Singapore Application No. 11202108809Q dated Apr. 7, 2022 (13 pages).

* cited by examiner (a)

(b)

(a)

(b)

(c)

PILE JOINT, PILE COUPLING STRUCTURE, AND PILE COUPLING METHOD

CROSS-REFERENCE TO RELATED APPLICATIONS

This application claims the benefit of Japanese Patent Applications No. 2019-22622 filed on Feb. 12, 2019 in Japan, and No. 2020-21278 filed on Feb. 12, 2020 in Japan, the contents of which are incorporated herein by reference.

TECHNICAL FIELD

The present invention relates to a pile joint, a pile coupling structure, and a pile coupling method.

BACKGROUND ART

In some cases where a pile to be installed underground is not long enough, two or more piles may be coupled together to be installed underground.

In such a case, weld joining, which couples piles by welding, requires time to weld at the site of underground installation, also requires an inspection of the weld, and therefore requires a lot of time and effort. The weather at the site of underground installation and the welder's skill may cause the welding quality to vary and, in addition, welding of piles itself may not be able to be carried out depending on head clearance or other conditions of the site.

On the other hand, Patent document 1, for example, discloses coupling of a plurality of cylindrical drilling members by means of a cylindrical joint member, as a mechanical joint that does not involve welding work at the site of underground installation. Each cylindrical drilling member is provided with a lug projected on the outer periphery of its one end, and the joint member fits to the lug to perform positioning.

PRIOR ART DOCUMENT

Patent Document

Patent document 1: Japanese Patent Laid-Open Application No. Sho 63-40088

SUMMARY OF THE INVENTION

Problems to be Solved by the Invention

However, even though the structure described in Patent document 1 allows the lugs of the cylindrical drilling members and the joint member to be fitted together to perform positioning, the cylindrical drilling members to be coupled will not be firmly united by the structure.

A purpose of the invention made in view of the above is to provide a pile joint, a pile coupling structure, and a pile coupling method that allow firm uniting of piles to be coupled.

Means for Solving the Problems

A pile joint of the invention is for coupling two piles, and the pile joint comprises: a tubular body into which each pile provided with a projection on a periphery thereof is inserted through an end of the body; and a fitting portion formed on the body so as to be fitted to the projection by the insertion and rotation of the pile, where the fitting portion is formed with: a first shape having a surface that is inclined so as to become distant from the end of the body as the surface extends in the direction of rotation of the pile; or a second shape for fitting between the projection and the pile.

In this configuration, since the fitting portion is formed with the first shape having the surface that is inclined so as to become distant from the end of the body as the surface extends in the direction of rotation of the pile, inserting the pile into the pile joint and rotating the pile cause the pile to move in the direction of the insertion, that is to say, in the direction of the other pile to be coupled by the pile joint. As a result, ends of the two piles to be coupled come into contact with each other and the inclined surface of the fitting portion also comes into contact with a surface of the projection facing the inclined surface, which causes the two piles and the pile joint to be tightened up. The first shape formed in the fitting portion thus allows firm uniting of the two piles to be coupled and the pile joint.

The fitting portion is also formed with the second shape for fitting between the projection and the pile, which produces the so-called wedge effect between the projection and the fitting portion and, for example, allows the prevention of slippage between the projection and the fitting portion which may occur when underground-installed piles are pulled out. The second shape formed in the fitting portion thus allows firm uniting of the piles and the pile joint.

In the pile joint of the invention, the fitting portion may be formed so that the second shape is formed on the surface forming the first shape. This configuration allows firmer uniting of the two piles to be coupled and the pile joint.

In the pile joint of the invention, the projection may have a planar shape, the inside of which is cut out. Welding the outer edge of the projection to provide the projection on the pile would produce a bead (weld mark) around the outer edge of the projection, and the bead might constitute an obstacle to the fitting between the projection and the fitting portion. This configuration allows a bead to be formed inside the planar shape by welding the cut-out inside of the planar shape, and therefore can prevent a bead from constituting an obstacle to the fitting between the projection and the fitting portion.

In the pile joint of the invention, each pile may be provided with a plurality of projections, each identical to the projection, spaced at unequal angles in a direction of circumference, and the body may be formed with a plurality of fitting portions, each identical to the fitting portion, corresponding to the projections. A simple structure with this configuration allows coupled piles to be strengthened by providing the projections at positions in the cross-sectional direction where the piles require to be relatively strong.

In the pile joint of the invention, the body may be provided with a reinforcing member for covering at least each fitting portion. The strength of the body relatively decreases in an area where the fitting portion is formed, and this configuration allows the reinforcing member to enhance the decreased strength.

The pile joint of the invention may comprise a retaining member to be fixed to the reinforcing member and prevent each projection from disengaging from the fitting portion. Methods of fixing the retaining member to the reinforcing member in this configuration include, for example, bolting, and inserting a pin formed on the retaining member into a hole formed on the reinforcing member, which can reliably prevent the projection provided on the pile from disengaging from the fitting portion.

In the pile joint of the invention, the reinforcing member may be formed with a hole for checking that each projection is inserted into the fitting portion. This configuration allows an operator to visually check how the projection is inserted into the fitting portion even when the reinforcing member is provided.

In the pile joint of the invention, each fitting portion may be formed with a plurality of first shapes, each identical to the first shape, or a plurality of second shapes, each identical to the second shape, arranged in a direction of an axis of the piles. The formation of a plurality of the first or second shapes on each fitting portion in this configuration allows firm uniting of the piles to be coupled.

In the pile joint of the invention, one of the two piles may be to be installed underground, and the other pile may be to be used in an auxiliary manner for installing the one pile underground and may be positioned above the one pile. The other pile to be used to assist in installing the one pile underground is coupled by the pile joint in this configuration, so that the pile can be installed underground without being suspended.

A pile coupling structure of the invention comprises: a pile provided with a projection on a periphery thereof; and a pile joint that has a tubular body into which the pile is inserted through an end of the body and comprises a fitting portion to be fitted to the projection by the insertion and rotation of the pile, the fitting portion being formed with: a first shape having a surface that is inclined so as to become distant from the end of the body as the surface extends in the direction of rotation of the pile; or a second shape for fitting between the projection and the pile. This configuration allows firmer uniting of the two piles to be coupled and the pile joint.

A pile coupling method of the invention is for coupling two piles by means of a pile joint that has a tubular body into which each pile provided with a projection on a periphery thereof is inserted through an end of the body and comprises a fitting portion to be fitted to the projection by the insertion and rotation of the pile, the fitting portion being formed with: a first shape having a surface that is inclined so as to become distant from the end of the body as the surface extends in the direction of rotation of the pile; or a second shape for fitting between the projection and the pile, where the pile coupling method has: a first step of installing one of the two piles underground; and a second step of standing the other pile above the underground-installed pile and rotating the other pile so that the two piles are fitted together by the pile joint. This configuration allows firmer uniting of the two piles to be coupled and the pile joint.

A pile coupling method of the invention is for coupling a first pile and a second pile by means of a pile joint that has a tubular body into which each pile provided with a projection on a periphery thereof is inserted through an end of the body and comprises a fitting portion to be fitted to the projection by the insertion and rotation of the pile, the fitting portion being formed with: a first shape having a surface that is inclined so as to become distant from the end of the body as the surface extends in the direction of rotation of the pile; or a second shape for fitting between the projection and the pile, where the pile coupling method has: a first step of gripping the second pile with a second gripper comprised in a press-in machine; a second step of gripping the first pile with a first gripper comprised in the press-in machine; and a third step of moving the first gripper so that ends of the first and second piles come into contact with each other, rotating the first or second gripper, and thereby coupling the first and second piles by means of the pile joint. This configuration allows more reliable coupling of the two piles since the two piles are coupled together by the pile joint with the piles being gripped by the first and second grippers, respectively.

Advantage of the Invention

The invention allows firm uniting of piles to be coupled.

MODES OF EMBODYING THE INVENTION

Embodiments of the invention will now be described with reference to the drawings. The embodiments described below are merely illustrative of ways to implement the invention, and do not limit the invention to the specific configurations described below. When the invention is to be implemented, any specific configuration may be appropriately adopted according to the embodiment.

First Embodiment

Figure 1:
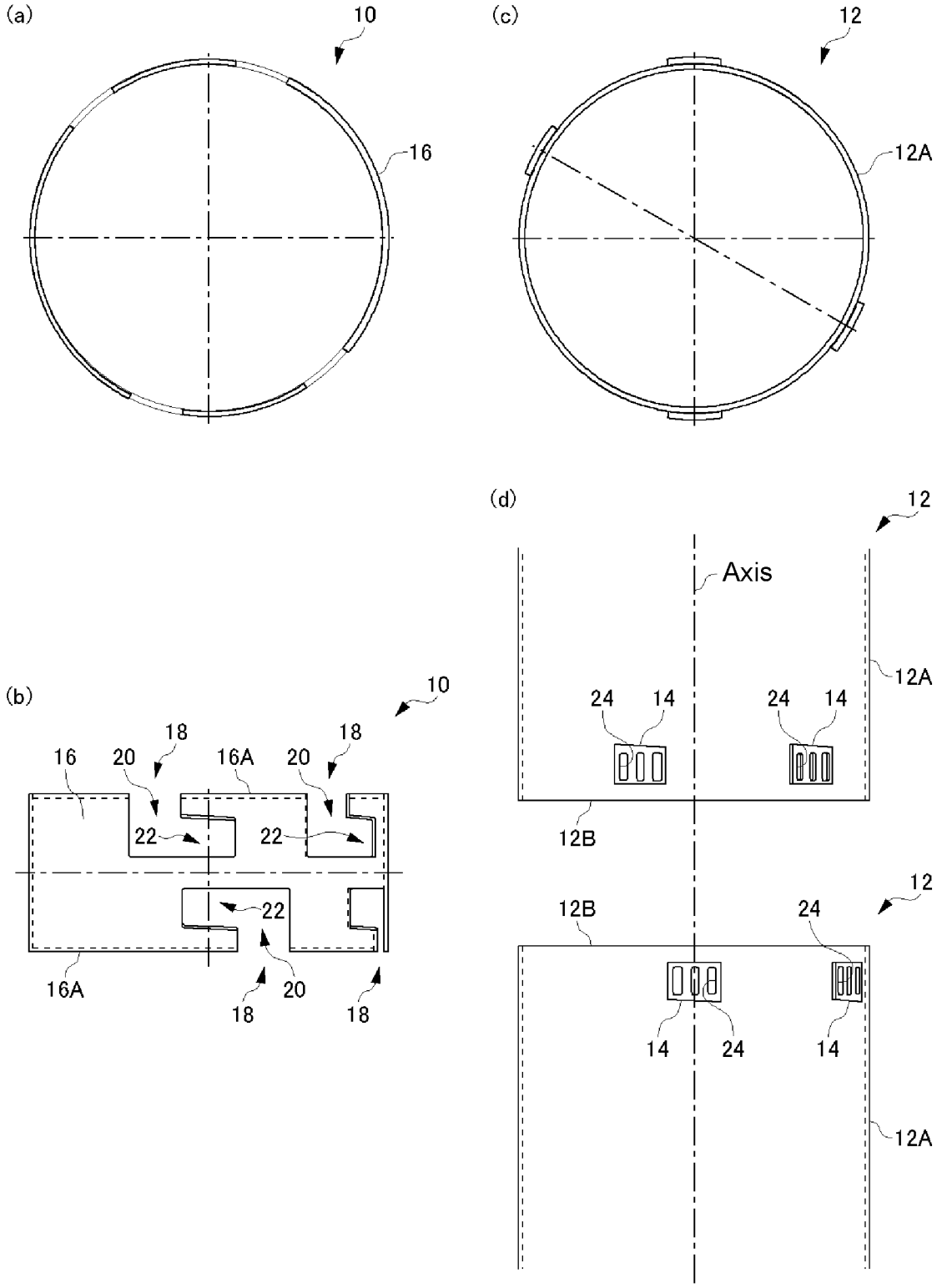
FIG. 1 is an external view of piles and a joint of a first embodiment, where (a) is a cross-sectional view of the joint, (b) is a side view of the joint, (c) is a cross-sectional view of one of the piles, and (d) is a side view of the piles.

FIG. 1 is an external view of a joint 10 and piles 12 and 12 comprised in a pile coupling structure of this embodiment. FIG. 1(*a*) is a cross-sectional view of the joint 10, FIG. 1(*b*) is a side view of the joint 10, FIG. 1(*c*) is a cross-sectional view of one of the piles 12, and FIG. 1(*d*) is a side view of the piles 12.

Each pile 12 of the embodiment is, for example, a pile to be installed underground and is provided with keys 14, each corresponding to the projection of the invention, on the outer periphery 12A of the pile. Four keys 14 are provided on the outer periphery 12A of each pile 12, which is, however, just an example and it is only required to provide at least one key 14 on the outer periphery 12A of each pile 12. Each key 14 is planar and is formed to have, for example, a rectangular shape with four surfaces.

The joint 10 couples the two piles 12 and 12 together, and corresponds to the pile joint of the invention. The joint 10 has a tubular body 16 into which each pile 12 is inserted through each of ends 16A and 16A, and the diameter of the inner circumference of the body 16 is formed slightly larger than the diameter of the outer circumference of the piles 12 so that the body 16 can cover the outer peripheries 12A of the piles 12.

The body 16 is formed with engaging portions 18, each of which engages with one of the keys 14 of one of the piles 12, each provided for one of the ends 16A and 16A. In other words, the joint 10 of the embodiment has a structure symmetric in the direction in which the piles 12 are coupled (also referred to as the "vertical direction"). The body 16 of the embodiment is formed with two sets of four engaging portions 18, the two sets arranged in the vertical direction, so that they correspond to each pile 12 provided with four keys 14.

Each engaging portion 18 is formed with: an inserting portion 20 into which each key 14 is inserted through the end 16A of the body 16; and a fitting portion 22 to be fitted to the key 14 by the insertion and rotation of one of the piles 12. Each inserting portion 20 is formed in a direction parallel to the direction of the axis of the piles 12, and the fitting portion 22 is formed in a direction intersecting the direction of the axis of the piles 12. This configuration causes each engaging portion 18 of the embodiment to have an L shape, but the shape is not limited to this and it is only required to form the shape to fit to the key 14, which is inserted through the inserting portion 20, in a direction intersecting the direction of the axis of the piles 12. For example, each engaging portion 18 may have an inverted T shape.

Figure 2:
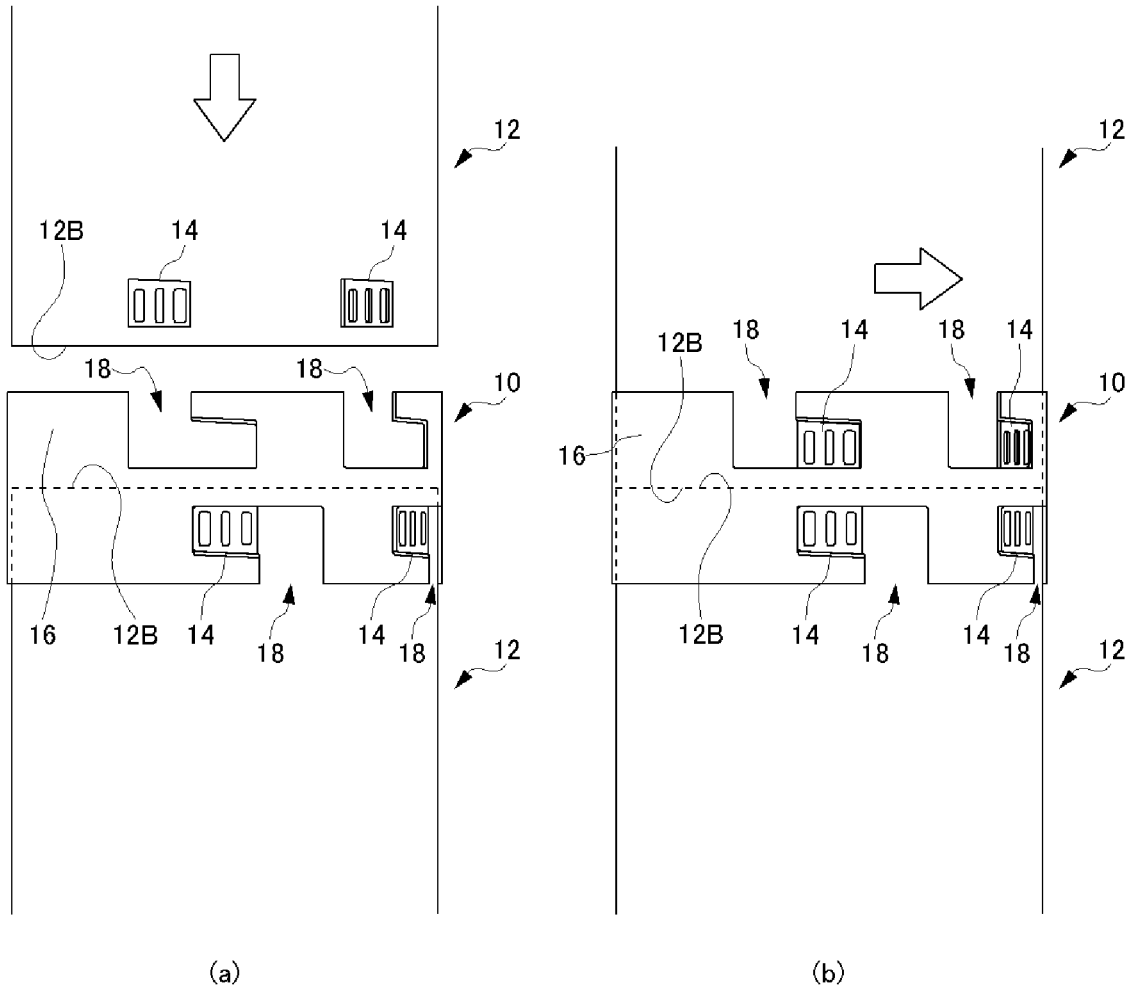
FIG. 2 shows a method of coupling the piles and joint of the first embodiment, where (a) is a step of inserting one of the piles into the joint, and (b) shows a step of rotating the pile with respect to the joint.

FIG. 2 shows a method of coupling the two piles 12 and 12 provided with the keys 14 and the joint 10. One of the piles 12 is inserted into the joint 10 through one of the ends 16A of the body 16, and the other pile 12 is inserted into the joint 10 through the other end 16A (FIG. 2(*a*)). One of the piles 12 is then rotated to cause the keys 14 provided on the piles 12 to fit to the fitting portions 22 of the joint 10, resulting in the coupling (FIG. 2(*b*)).

Ends 12B and 12B of the two piles 12 and 12 coupled by the joint 10 are in contact with each other. In other words, the keys 14 provided on the piles 12 and the fitting portions 22 of the joint 10 have a positional relation in which the ends 12B and 12B of the piles 12 and 12 come into contact with each other when the two piles 12 and 12 are coupled by the joint 10. In the embodiment, for example, the keys 14 are provided on the piles 12 in accordance with the positions of the fitting portions 22 so that the ends 12B and 12B of the piles 12 and 12 come into contact with each other at the center in the height direction of the joint 10.

Figure 3:
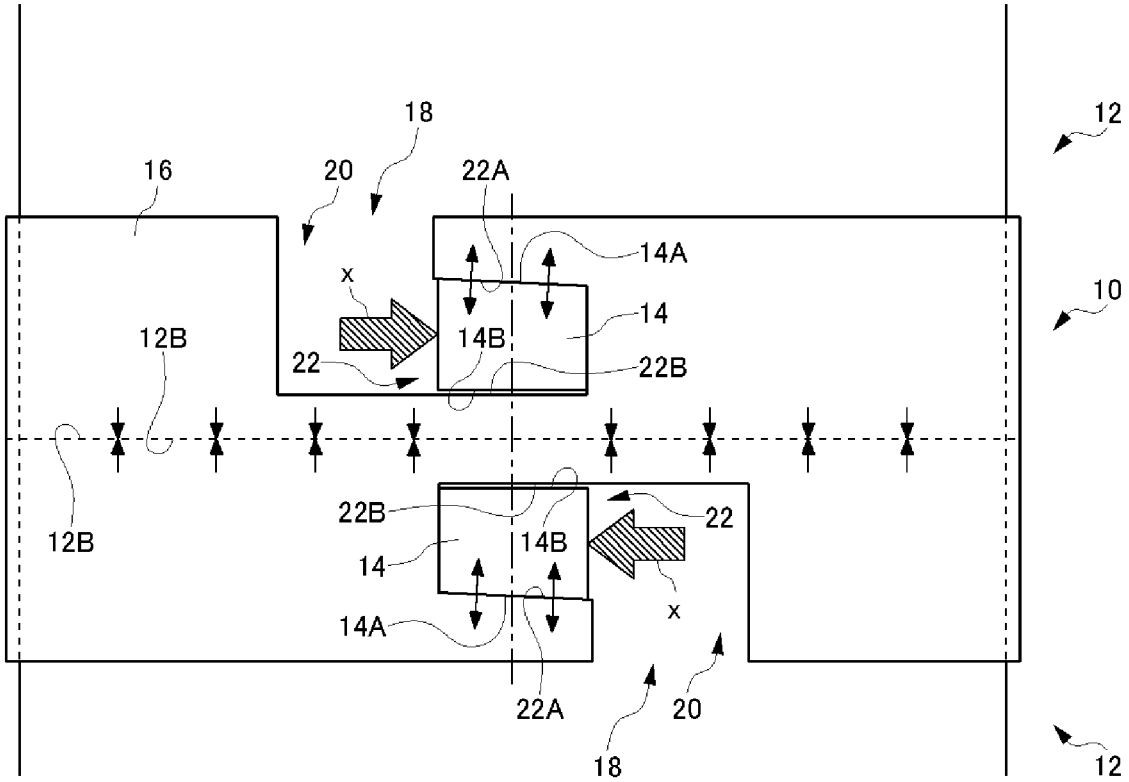
FIG. 3 is an enlarged view showing a state in which keys and fitting portions of the first embodiment are fitted together.
Figure 4:
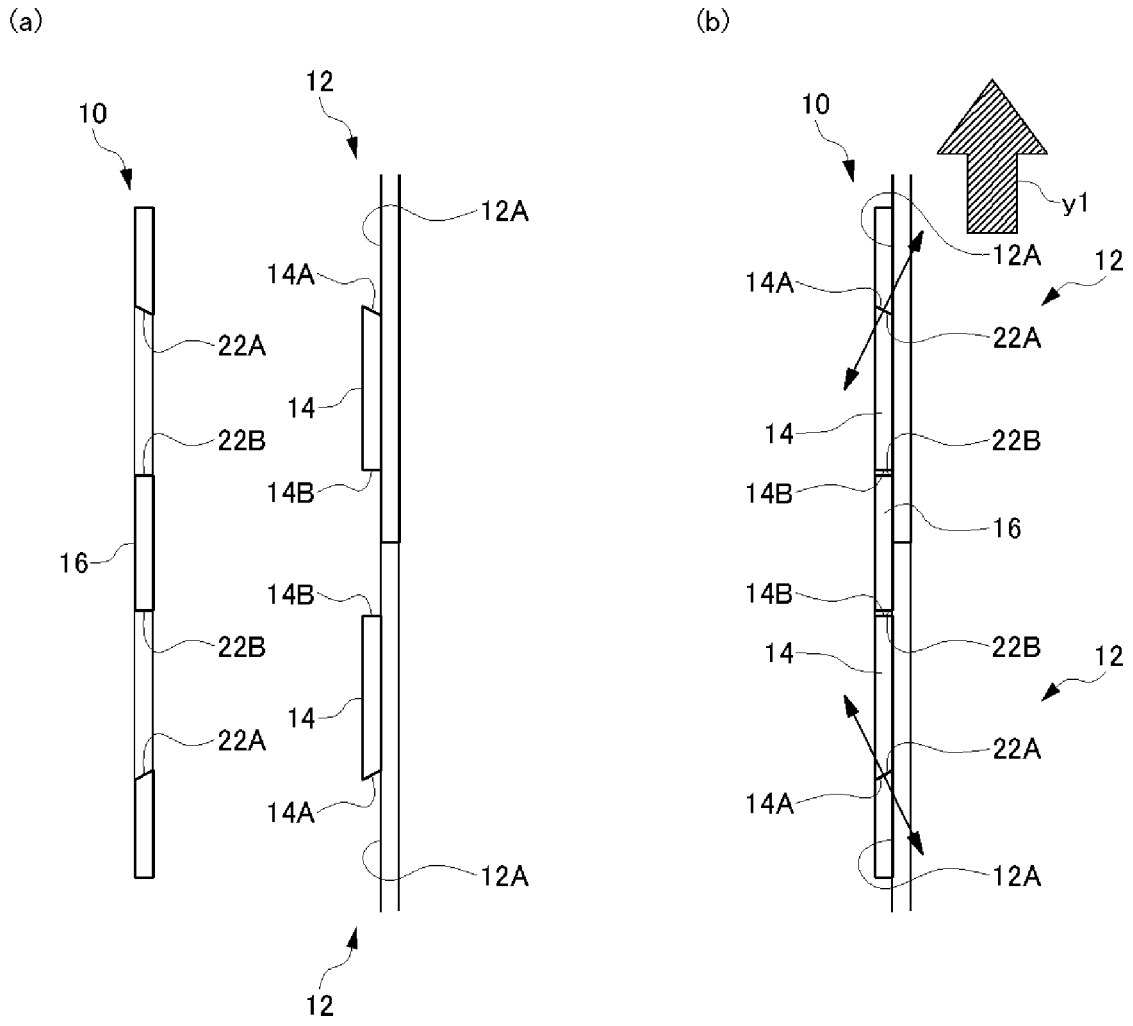
FIG. 4 is a longitudinal sectional view of the piles where the keys are provided and of the joint where the fitting portions are formed in the first embodiment, where (a) separately shows the piles and the joint, and (b) shows a state in which the piles and the joint are coupled together.

The shapes of each key 14 and the joint 10 will now be described in detail with reference to FIGS. 3 and 4 of the embodiment. FIG. 3 is an enlarged view showing a state in which the keys 14 and the fitting portions 22 are fitted together. FIG. 4 is a longitudinal sectional view of the piles 12 where the keys 14 are provided and of the joint 10 where the fitting portions 22 are formed. FIG. 4(*a*) separately shows the piles 12 and the joint 10, and FIG. 4(*b*) shows a state in which the piles 12 and the joint 10 are coupled together.

As shown in FIG. 3, each fitting portion 22 has a surface 22A that is inclined so as to become distant from the end 16A of the body 16 as the surface 22A extends in the direction of rotation x of the pile 12, and is thus formed with a tapered shape corresponding to the first shape of the invention. In other words, the surface 22A of each fitting portion 22 is inclined toward the coupling of the two piles 12 and 12 to be coupled. Surfaces 22B each opposed to the surface 22A are formed to be parallel to the ends 16A of the body 16.

Each key 14 is shaped corresponding to such a tapered shape of the fitting portion 22. Specifically, each key 14 has surfaces 14A and 14B which intersect the axis of the piles 12 and are opposite to each other. Each surface 14B is located on the side closer to the end 12B of the pile 12, and is formed to be parallel to the end 12B of the pile 12. On the other hand, each surface 14A is formed to be inclined toward the end 12B of the pile 12. The inclination angle of the surface 14A of each key 14 is the same as that of the surface 22A of the fitting portion 22.

As just described, each fitting portion 22 is formed with a tapered shape having the inclined surface 22A, and therefore each pile 12, when inserted into the joint 10 and rotated, moves in the direction of the insertion, that is to say, in the direction of the other pile 12 to be coupled by the joint 10. As a result, the ends 12B and 12B of the two piles 12 and 12 to be coupled come into contact with each other and the inclined surface 22A of each fitting portion 22 also comes into contact with the surface 14A of the key 14 facing the inclined surface 22A, which causes the two piles 12 and the joint 10 to be tightened up. The simple configuration of the tapered shape formed in each fitting portion 22 thus allows firm uniting of the two piles 12 and 12 to be coupled and the joint 10.

When the piles 12 and 12 are tightened to be a rigid body by the joint 10 whose fitting portions 22 are tapered as described above, the surface 22B of each fitting portion 22 is not in contact with but apart from the surface 14B of the key 14.

As shown in FIG. 4(*a*), each fitting portion 22 is formed with a wedge shape that fits between the key 14 and the pile 12 and corresponds to the second shape of the invention. This wedge shape is formed by chamfering the surface 22A of each fitting portion 22 in the direction of the pile 12 to be coupled. In this manner, the surface 22A of each fitting portion 22 of the embodiment is formed to be the wedge shape as well as the tapered shape.

The surface 14A of each key 14 is also formed to be inclined toward the pile 12 so as to correspond to the wedge shape of the surface 22A of the fitting portion 22. That is to say, the surface 14A of each key 14 and the outer periphery 12A of the pile 12 together form a V shape, to which the surface 22A of the fitting portion 22 is fitted. This produces the so-called wedge effect between the fitting portion 22 and the key 14 and, for example, allows the prevention of slippage between the fitting portion 22 and the key 14 which may occur when underground-installed piles 12 are pulled out (in the direction of an arrow y1 shown in FIG. 4(*b*)). The simple configuration of the wedge shape formed in each fitting portion 22 thus allows firmer uniting of the piles 12 and the joint 10.

Welding the outer edge of each key 14 to provide the key 14 on the pile 12 would produce a bead (weld mark) around the outer edge of the key 14, and the bead might constitute an obstacle to the fitting between the key 14 and the fitting portion 22. This would result in the need for a process of removing the bead by polishing or the like. For this reason, the inside of the planar shape of each key 14 of the embodiment is cut out (see FIG. 1). This allows a bead to be formed inside the planar shape of the key 14 by welding the cut-out inside of the planar shape, and therefore can prevent a bead from constituting an obstacle to the fitting between the key 14 and the fitting portion 22.

An example of the cut-out-inside shape 24 of the embodiment is formed to be rectangular, where three cut-out-inside shapes 24 are provided on each key 14 along the direction of circumference of the pile 12. It is only required to form one or more cut-out-inside shapes 24 on each key 14, and the shape and size of them are not limited as long as they are formed to be weldable to provide the key 14 on the pile 12.

Portions of each pile 12 where the keys 14 are provided are strengthened in the cross-sectional direction of the pile 12. The keys 14 of the embodiment are therefore spaced at unequal angles in the direction of the outer circumference of each pile 12. Two pairs of opposed keys 14 are provided in an example of the arrangement of the keys 14 shown in FIG. 1(*c*), where the total of four keys 14 are arranged with spacings of 120 degrees and 60 degrees.

A simple structure with such an arrangement of unequally spaced keys 14 allows the two coupled piles 12 and 12 to be strengthened by providing the keys 14 at positions in the cross-sectional direction where the piles 12 require to be relatively strong.

The arrangement of the keys 14 is not limited to the unequal spacing, and they may be spaced at equal angles in the direction of circumference. This configuration eliminates the requirement for considering the positions of the keys 14 provided on the piles 12 to fit the piles 12 and the joint 10, and therefore allows the piles 12 and the joint 10 to be easily fitted together.

Figure 5:
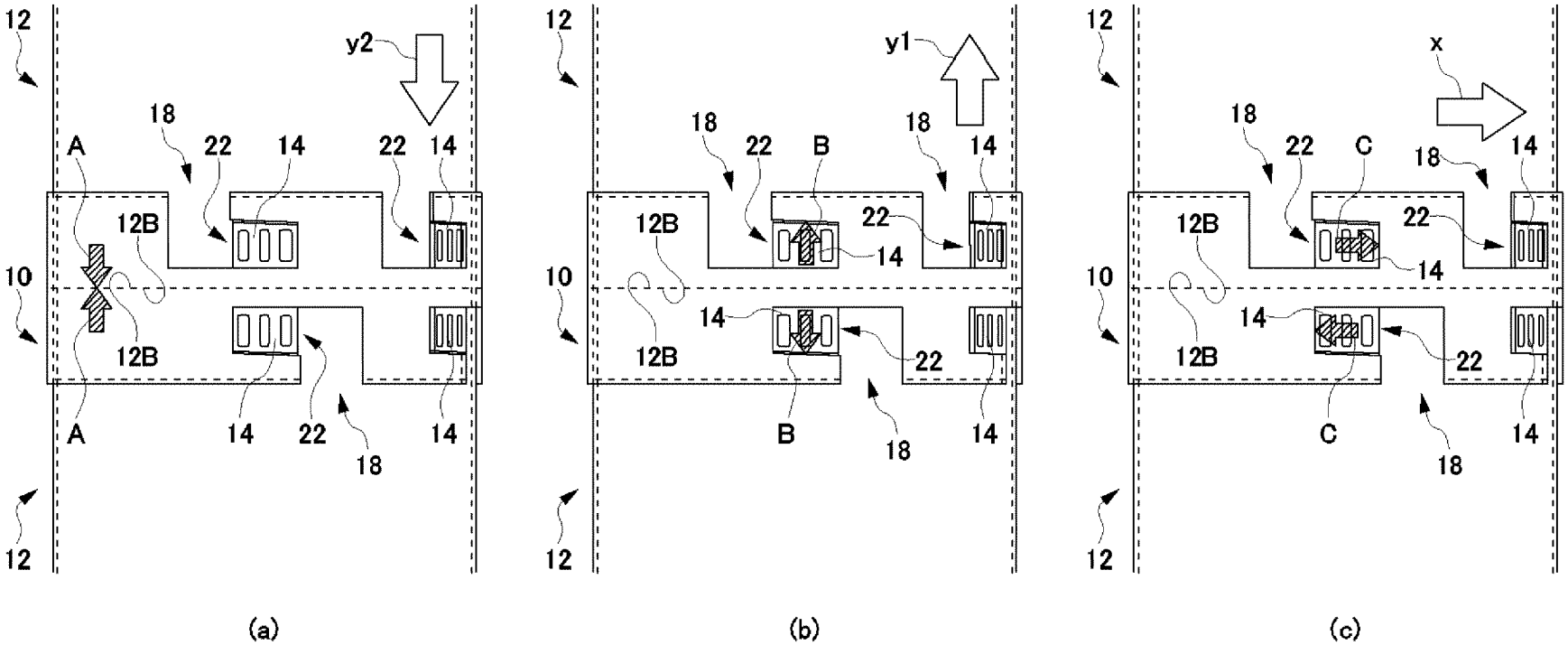
FIG. 5 shows load transfer points of the two piles and joint of the first embodiment in the coupling of the two piles, where (a) shows load transfer points in the press-in of the piles, (b) shows load transfer points in the pulling-out of the underground-installed piles, and (c) shows load transfer points in the rotation of the piles.

FIG. 5 shows load transfer points of the two piles 12 and 12 and the joint 10 in the coupling of the two piles 12 and 12.

FIG. 5(*a*) shows load transfer points in the press-in of the piles 12 (press-in in a downward direction, y2, with respect to the piles 12). A downward force is applied to the piles 12 in the press-in of the piles 12, and therefore the load transfer points are the ends 12B and 12B at which the two coupled piles 12 and 12 come into contact with each other, as indicated by arrows A.

FIG. 5(*b*) shows load transfer points in the pulling-out of the underground-installed piles 12 (pulling-out in an upward direction, y1, with respect to the piles 12). An upward force is applied to the piles 12 in the pulling-out of the piles 12, and therefore the load transfer points are the tapered shapes (wedge shapes) of the fitting portions 22 and the keys 14, as indicated by arrows B.

FIG. 5(*c*) shows load transfer points (torque transfer points) in the rotation of the piles 12 (rotation in a rightward direction, x, with respect to the piles 12). A force in a rightward rotational direction is applied to the piles 12 in the rotation of the piles 12, and therefore the load transfer points are front ends of the tapered shapes of the fitting portions 22 and the keys 14, as indicated by arrows C.

Figure 6:
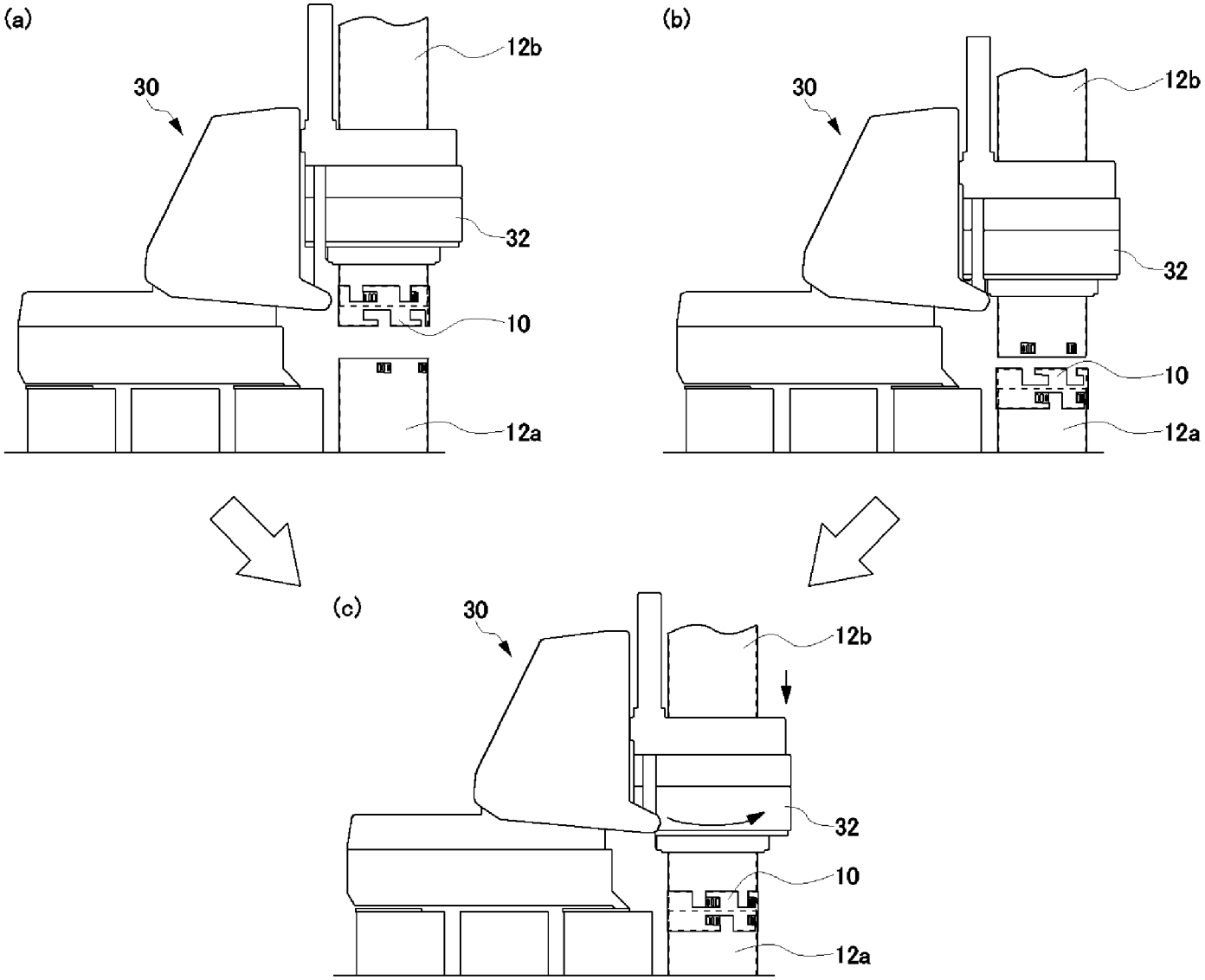
FIG. 6 shows a procedure of coupling the two piles of the first embodiment and installing them underground using a press-in machine, where (a) and (b) show a step of inserting the joint into one of the piles, and (c) shows a step of rotating the pile so that the two piles are coupled by the joint.

FIG. 6 shows a procedure of coupling the two piles 12 and 12 and installing them underground using a press-in machine 30.

First, the press-in machine 30 uses a chuck 32 to grip one pile 12*a* and install it underground. Next, the press-in machine 30 uses the chuck 32 to grip the other pile 12*b* to be coupled to the pile 12*a*. With the pile 12*b* gripped by the chuck 32, the keys 14 of the pile 12*b* are then inserted into the inserting portions 20 of the joint 10 to engage the joint 10 with the pile 12*b*, and the joint 10 is rotated to fit the keys 14 to the fitting portions 22 (FIG. 6(*a*)). The pile 12*b* fitted to the joint 10 is then stood above the underground-installed pile 12*a*, and the other pile 12*b* is rotated so that the two piles 12*a* and 12*b* are coupled together by the joint 10 (FIG. 6(*c*)). Standing the pile 12*b* above the underground-installed pile 12*a* here means vertically positioning the pile 12*b* so that the axes of the piles 12*a* and 12*b* coincide with each other.

The procedure is not limited to the above, and may be as follows: engage the joint 10 with the underground-installed pile 12*a* (FIG. 6(*b*)); stand the pile 12*b* above the pile 12*a* fitted with the joint 10; and rotate the other pile 12*b* so that the two piles 12*a* and 12*b* are coupled together by the joint 10 (FIG. 6(*c*)).

FIGS. 7 to 10 show a mode in which the joint 10 is provided with a reinforcing member 40.

Figure 7:
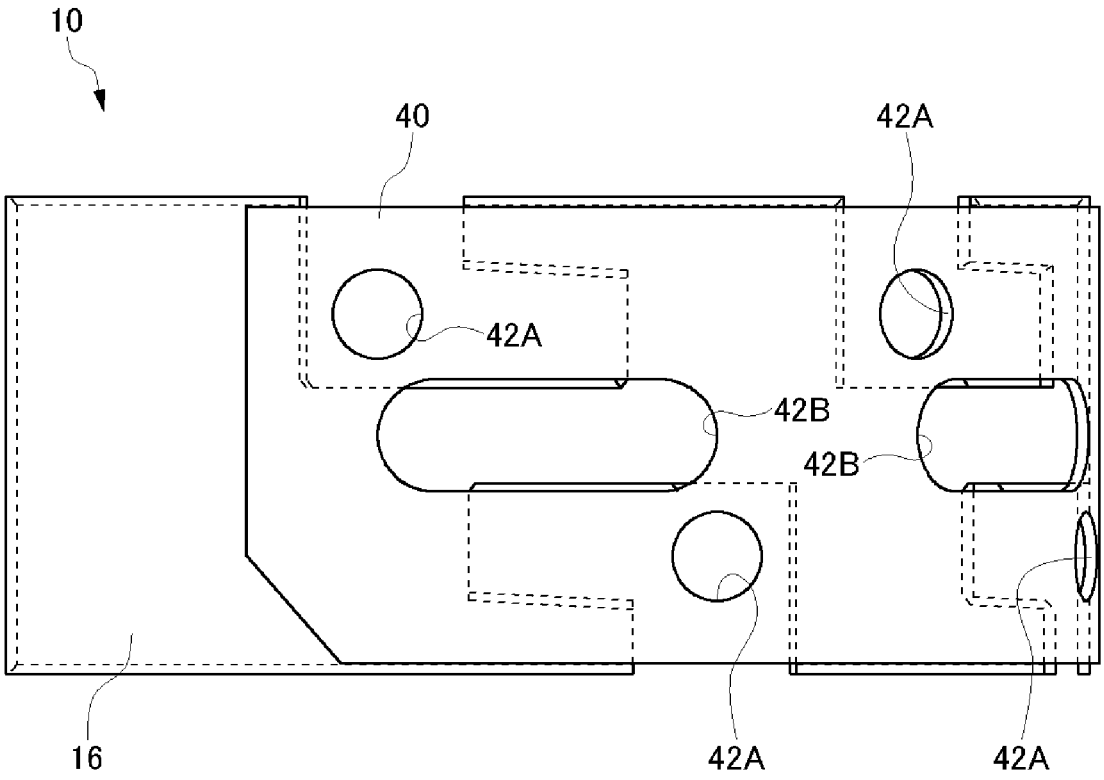
FIG. 7 is an external view of a reinforcing member of the first embodiment.

Since the fitting portions 22 are load transfer points as shown in FIG. 5, the strength of the joint 10 relatively decreases in the vicinity of areas where the fitting portions 22 are formed as compared with other areas. The body 16 of the embodiment is therefore provided with the reinforcing member 40 for covering at least the fitting portions 22 as shown in FIG. 7. This configuration allows the reinforcing member 40 to enhance the strength decreased by the formation of the fitting portions 22, and can suppress deformation in the joint 10 in load transfer. The reinforcing member 40 of the embodiment covers not just the fitting portions 22 but areas surrounding the inserting portions 20. The reinforcing member 40 is joined to the body 16 in advance by welding or the like.

The reinforcing member 40 of the embodiment is formed with a hole 42 for checking the insertion of each key 14. Examples of the hole 42 formed on the reinforcing member 40 are formed at the position of each inserting portion 20 (hole 42A) and at the position of each fitting portion 22 (hole 42B). The hole 42A is circular. The hole 42B is formed to be a rectangle (rounded rectangle) whose long side is in the direction intersecting the direction of the axis of the joint 10, and is formed so as to extend over upper and lower fitting portions 22. The hole 42 formed on the reinforcing member 40 in this manner allows an operator to visually check how each key 14 is inserted into the inserting portion 20 and fitting portion 22 even when the reinforcing member 40 is provided.

Figure 8:
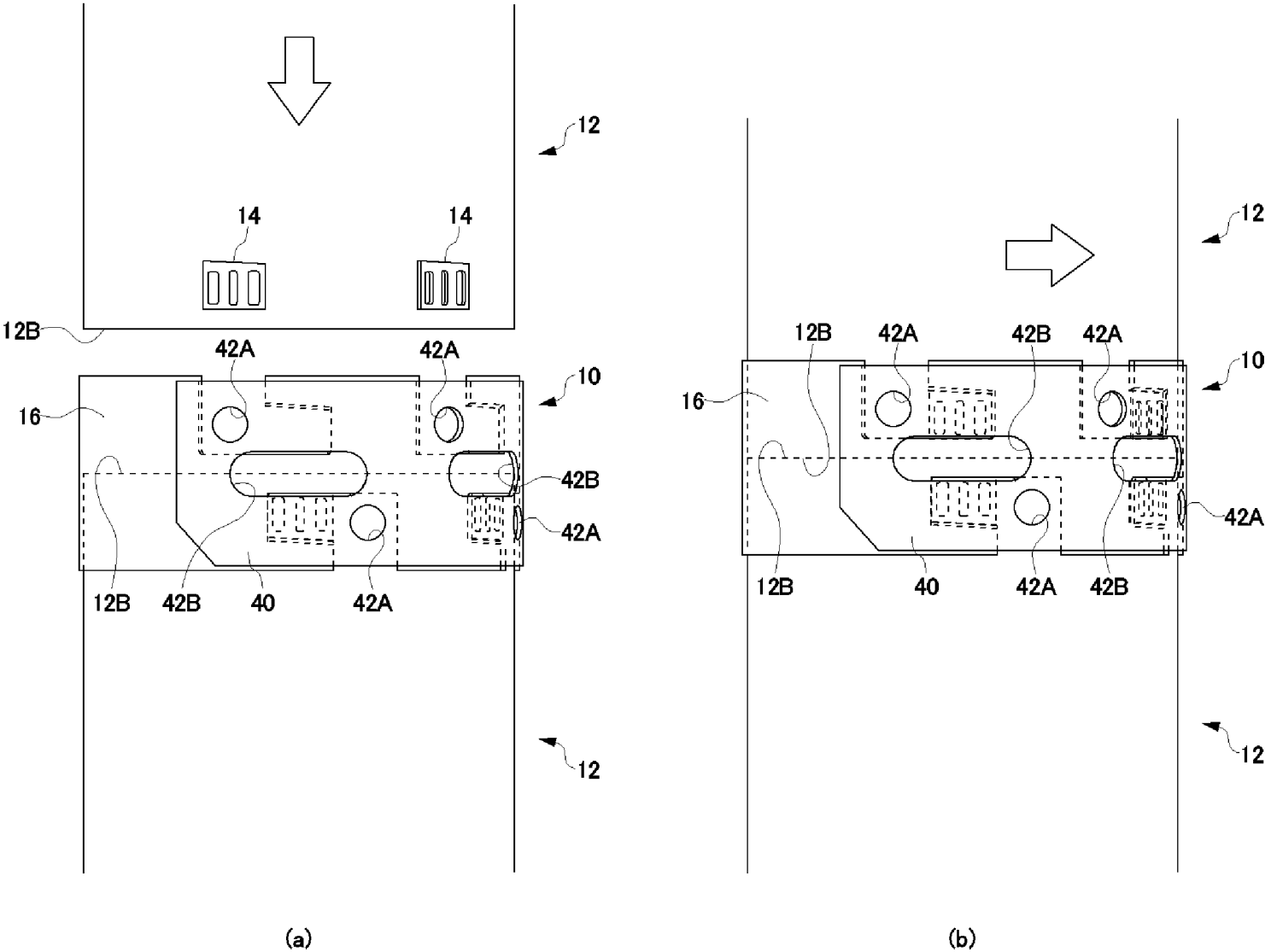
FIG. 8 shows a method of coupling the piles and joint of the first embodiment, where (a) is a step of inserting one of the piles into the joint, and (b) shows a step of rotating the pile with respect to the joint.

FIG. 8 shows a method of coupling the two piles 12 and 12 and the joint 10 provided with the reinforcing member 40. The provision of the reinforcing member 40 does not change the method of coupling the piles 12 and the joint 10, where each pile 12 is inserted through each end 16A of the body 16 comprised in the joint 10 (FIG. 8(*a*)) and the pile 12 is rotated to fit the keys 14 to the fitting portions 22, allowing the coupling (FIG. 8(*b*)).

Figure 9:
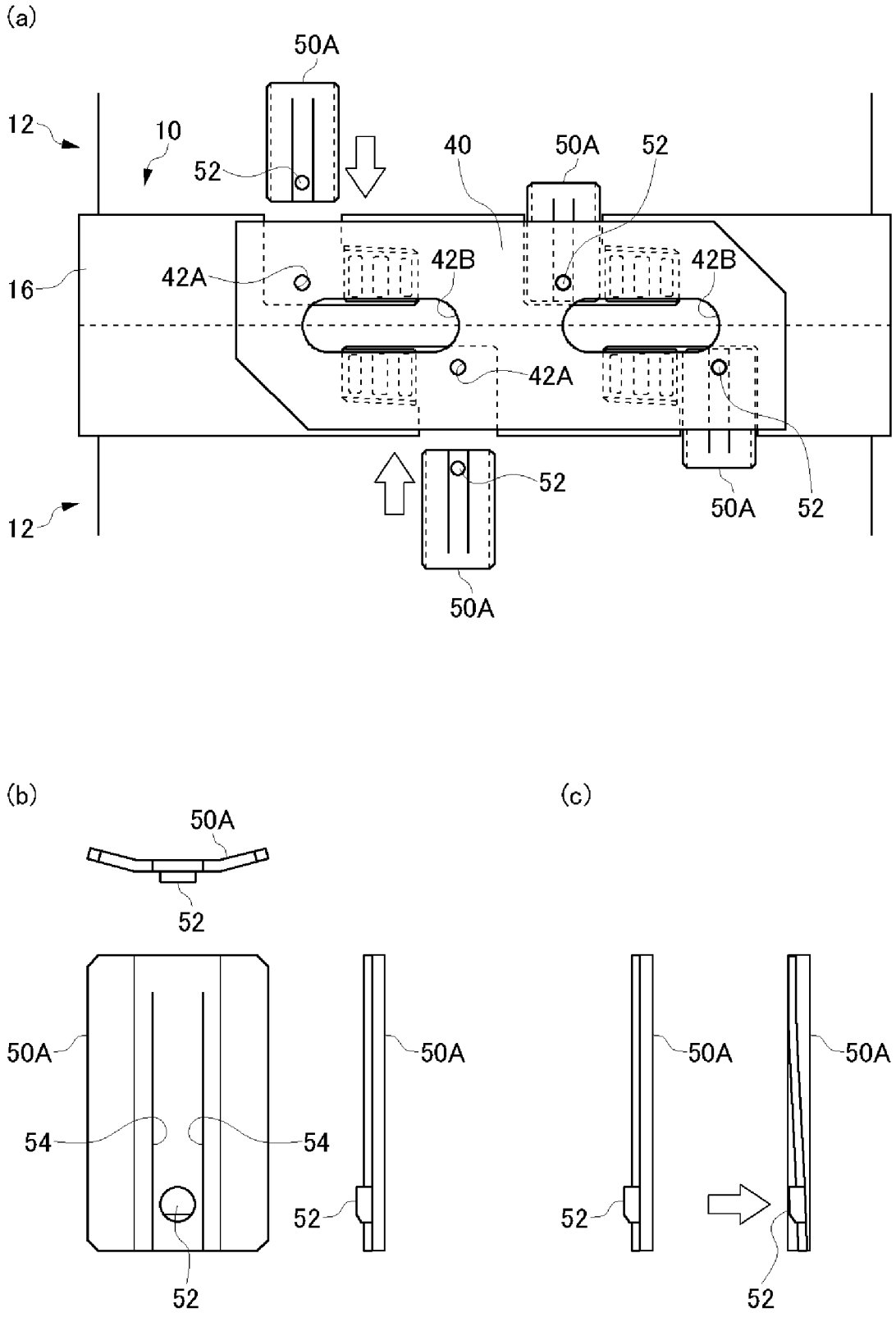
FIG. 9 shows stoppers of the first embodiment, where (a) shows a state in which the stoppers are inserted after the joint and the piles are coupled together, (b) is an external view of one of the stoppers, and (c) shows a change in the position of a pin due to springback of a cantilever spring.

The keys 14 engaged with the fitting portions 22 of the joint 10 may disengage from the fitting portions 22 if the piles 12 rotate in the reverse direction when the piles 12 are pressed in. Therefore, the joint 10 of the embodiment may be provided with a backstop 50A for preventing the keys 14 from disengaging from the fitting portions 22, the backstop 50A corresponding to the a retaining member of the invention, as shown in FIG. 9. FIG. 9(*a*) shows an example of using backstops 50A, and is a developed view in which the joint 10 and the reinforcing member 40 are developed in the direction of the outer circumference of the piles 12. FIG. 9(*b*) shows front, top, and side views of each backstop 50A. FIG. 9(*c*) shows an action of a pin 52 formed on each backstop 50A.

As shown in FIG. 9(*a*), each backstop 50A is inserted into the inserting portion 20 after the piles 12 and 12 are coupled together by the joint 10. For this purpose, each backstop 50A is formed slightly smaller in width than the inserting portion 20, and is formed so as to extend along the outer periphery 12A of the pile 12.

Each backstop 50A of the embodiment is formed with a pin 52 that matches with the hole 42A of the reinforcing member 40, and slits 54 are formed on both sides of the pin 52. This means that when each backstop 50A is inserted into the inserting portion 20, the pin 52 is pushed due to springback of the cantilever spring, and the area between the slits 54 is bent. The pin 52 engages with the hole 42A when the backstop 50A is inserted as far as the pin 52 reaches the hole 42A. This allows the backstop 50A to be fixed to the inserting portion 20 to prevent the keys 14 from disengaging from the fitting portions 22, and therefore can reliably prevent the piles 12 fitted to the joint 10 from disengaging from the joint 10.

Figure 10:
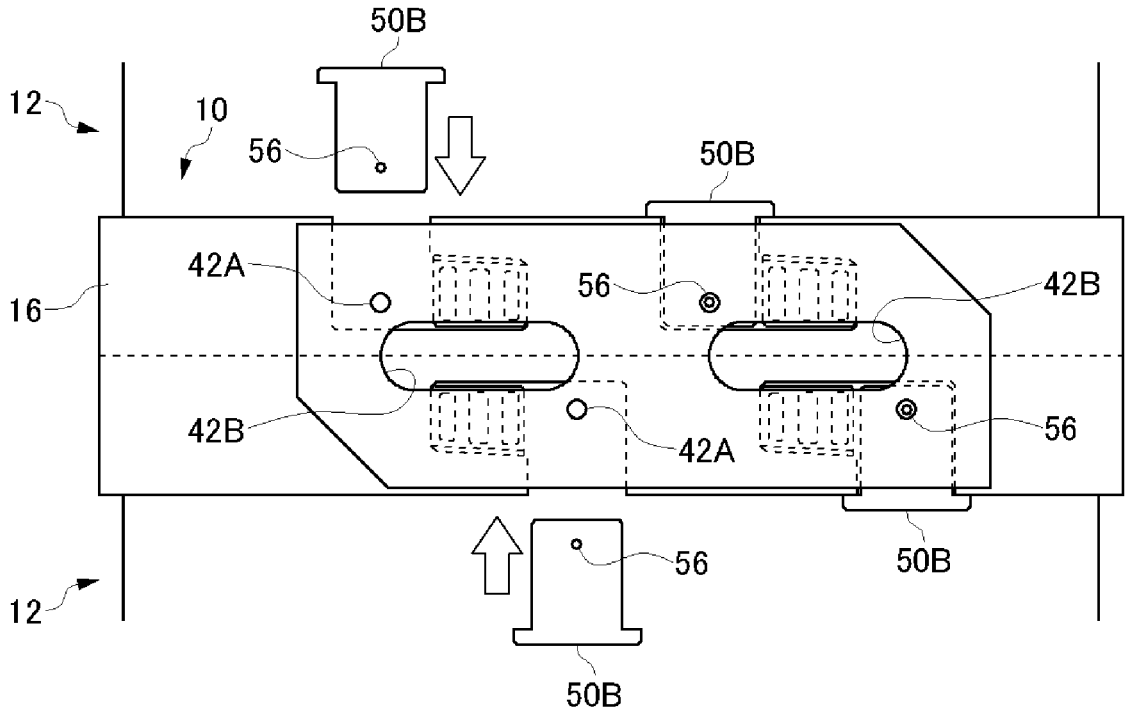
FIG. 10 shows a variation of the stoppers of the first embodiment, where (a) shows a state in which the stoppers are inserted after the joint and the piles are coupled together, and (b) is an external view of one of the stoppers.
Figure 10:
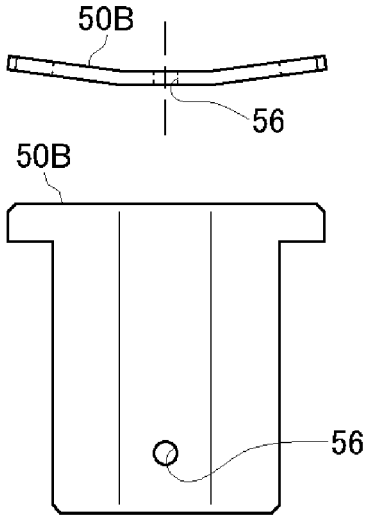

FIG. 10 shows a backstop 50B of another mode of the retaining member of the invention. FIG. 10(*a*) shows an example of using backstops 50B, and is a developed view in which the joint 10 and the reinforcing member 40 are developed in the direction of the outer circumference of the piles 12. FIG. 10(*b*) shows front and top views of each backstop 50B. Each backstop 50B is formed with a hole 56 that matches with the hole 42A of the reinforcing member 40, and the hole 56 is formed with a female thread. Each backstop 50B is inserted into the inserting portion 20, then a bolt is inserted through the hole 42A of the reinforcing member 40, and then the bolt and the hole 56 of the backstop 50B are screwed together. As a result, the bolt fastens the reinforcing member 40 to the backstop 50B, and the backstop 50B is fixed to the reinforcing member 40.

Figure 11:
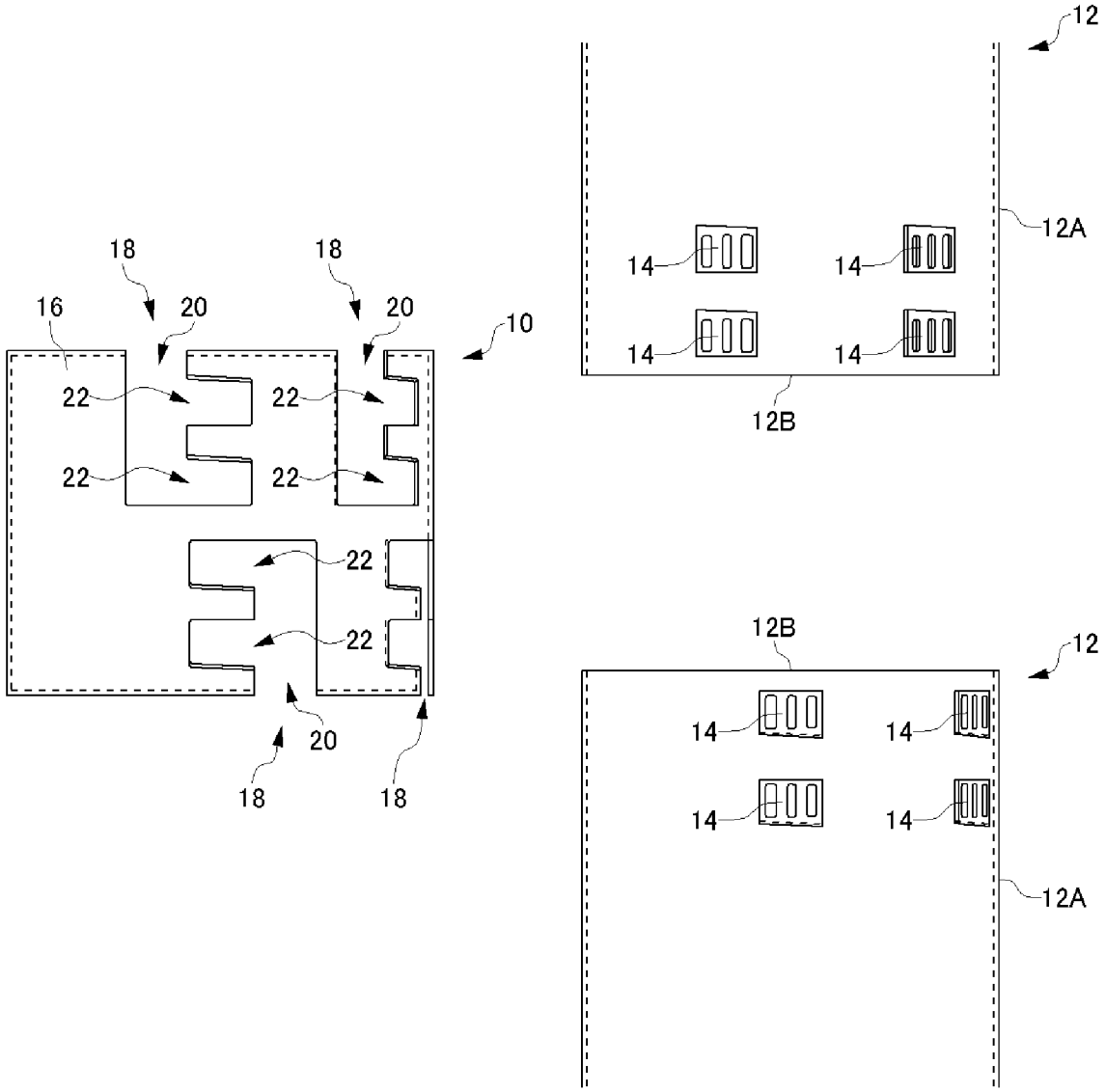
FIG. 11 is an external view of a variation of the piles and joint of the first embodiment.

While a description has been made for the embodiment on modes in which the keys 14 are provided in a line in the lateral direction of each pile 12, the embodiment is not limited to this, and the keys 14 may be provided in two or more lines in the direction of the axis of each pile 12 as shown in FIG. 11. Two or more lines of the fitting portions 22 are then formed on the joint 10 so as to match with the two or more lines of the keys 14.

Figure 12:
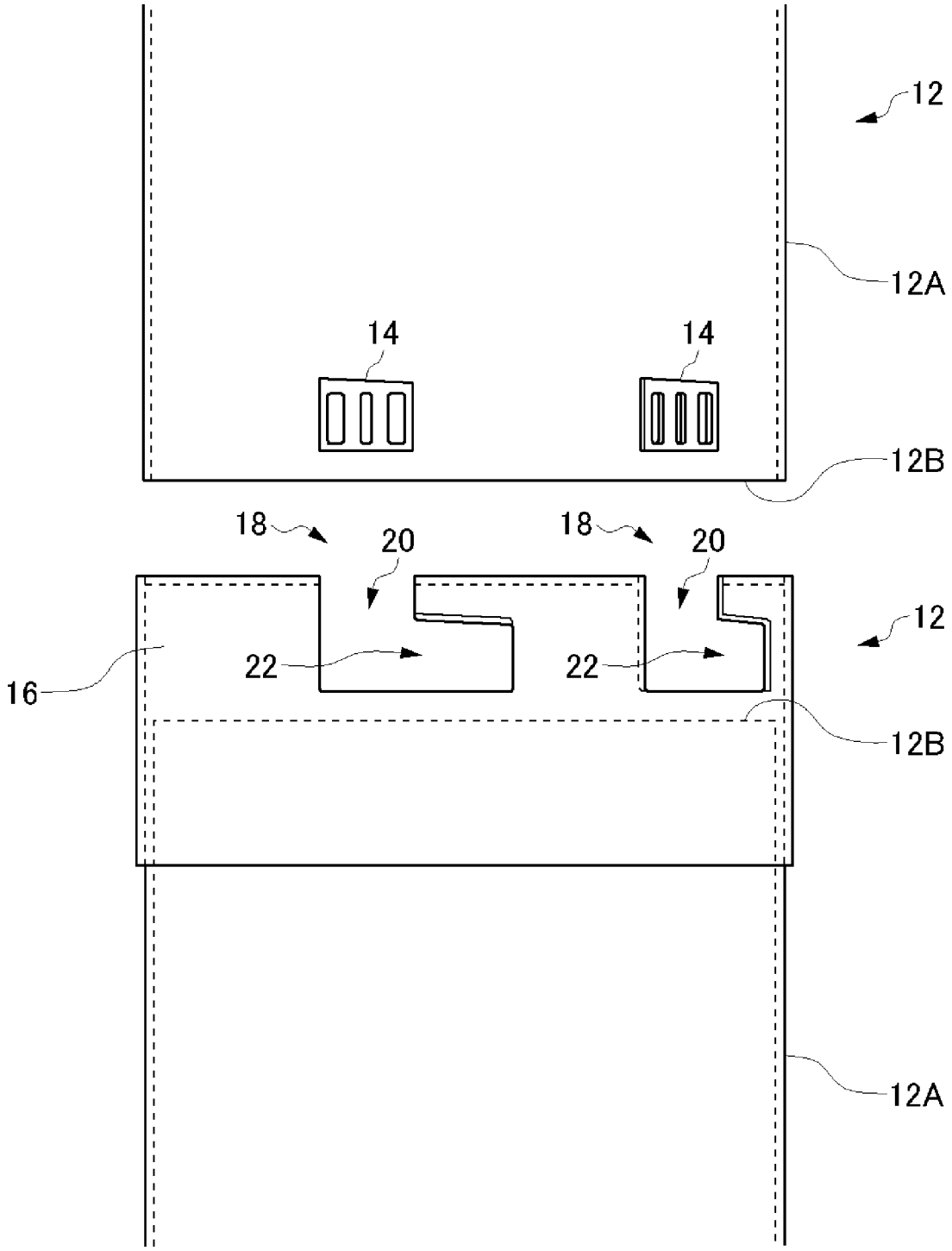
FIG. 12 is an external view of a variation of the piles and joint of the first embodiment.

While a description has been made for the embodiment on modes in which the joint 10 is separate from the piles 12, the embodiment is not limited to this, and the joint 10 may be joined to an end of one of the two piles 12 as shown in FIG. 12.

Second Embodiment

Figure 13:
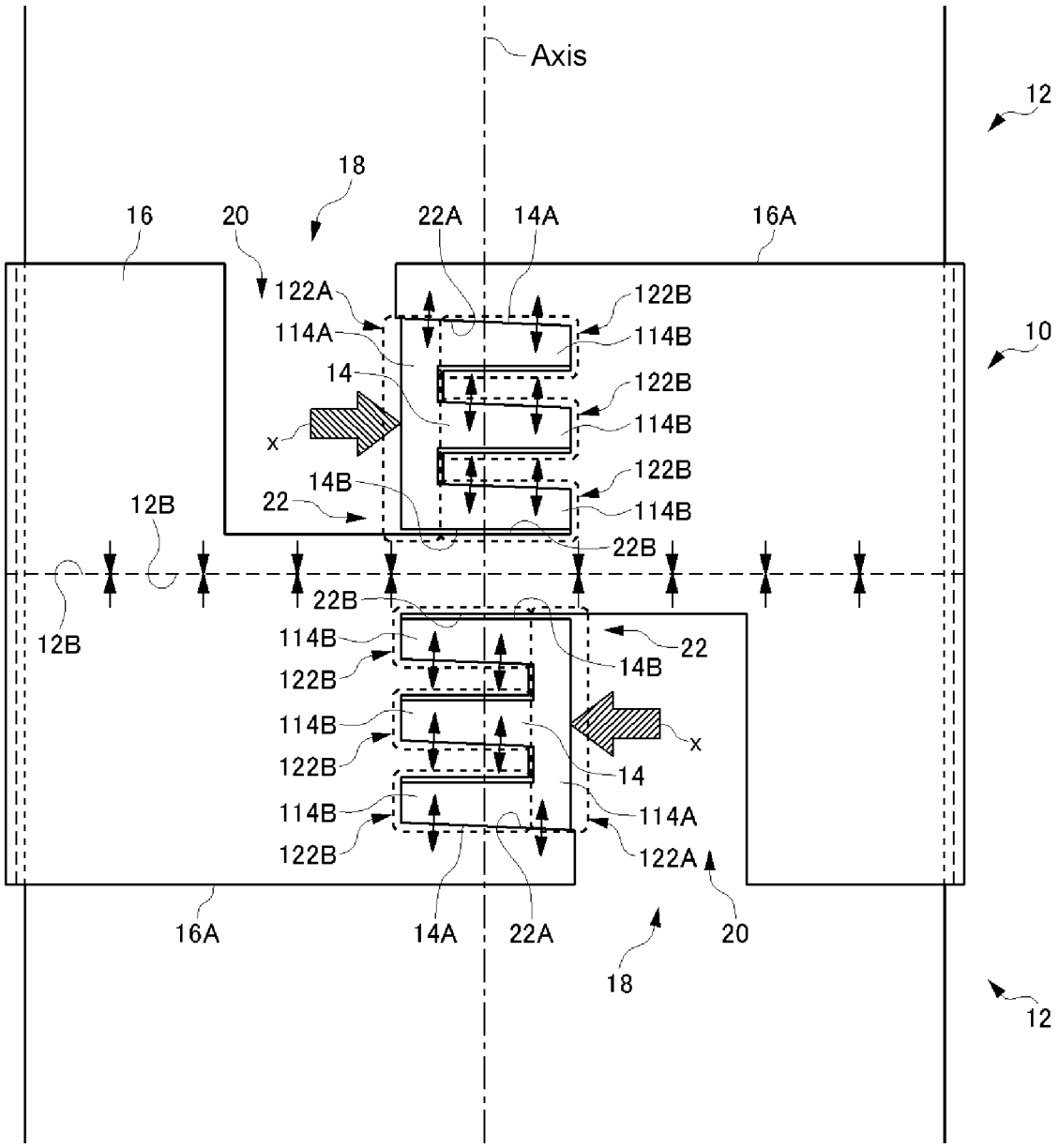
FIG. 13 is an external view of piles and a joint of a second embodiment.

FIG. 13 is an external view of piles 12 and a joint 10 of this embodiment. The same components in FIG. 13 as in FIGS. 1 to 12 are designated by the same symbols as in FIGS. 1 to 12 and the like, and their descriptions are omitted.

Each fitting portion 22 formed on the joint 10 of the embodiment is formed with a plurality of tapered shapes and a plurality of wedge shapes arranged in the direction of the axis of the piles 12. More specifically, each fitting portion 22 comprises a vertical portion 122A that is parallel to the direction of the axis of the piles 12 and a plurality of horizontal portions 122B that are perpendicular to the vertical portion 122A. This means that each horizontal portion 1228 is formed with a tapered shape and a wedge shape on the side closer to the end 16A of the joint 10.

An example of the vertical portion 122A is formed in such a way that the tapered shape and wedge shape of the horizontal portion 1228 extend to the side closer to the end 16A of the joint 10. The shape of the vertical portion 122A on the side closer to the end 16A of the joint 10 is not limited to this, and may be a horizontal surface.

Each key 14 of the embodiment is shaped corresponding to the tapered shape and wedge shape of the fitting portion 22 of the embodiment. Each key 14 therefore comprises a vertical portion 114A that is parallel to the direction of the axis of the piles 12 and three horizontal portions 1148 that are perpendicular to the vertical portion 114A.

The joint 10 of the embodiment with the fitting portions 22 each formed with a plurality of the tapered shapes and wedge shapes in this manner allows firm uniting of the piles 12 to be coupled. As compared with the arrangement of lines of the keys 14 of the first embodiment described with reference to FIG. 11, this configuration eliminates the requirement for aligning one line of keys 14 above another in welding, and thus can reduce work processes. That is to say, even the configuration shown in FIG. 11 allows firmer coupling of the two piles 12 since it has a plurality of fitting portions 22 arranged in the vertical direction, but it requires a process for welding a plurality of keys 14 in the vertical direction without misalignment. In the embodiment, however, just welding one key 14 allows the key 14 to be fitted to a plurality of fitting portions 22.

Each fitting portion 22 is formed with three horizontal portions 1228 (tapered shapes and wedge shapes) in the example of the embodiment, but the configuration is not limited to this, and each fitting portion 22 may be formed with two horizontal portions 1228 or with four or more horizontal portions 1228. Each key 14 of the embodiment is formed with the horizontal portions 114B the number of which corresponds to the shape of the fitting portion 22.

Third Embodiment

In this embodiment, one of the two piles 12 to be coupled by the joint 10 shall be the pile 12 to be installed underground, and the other pile 12 shall be a pile to be used in an auxiliary manner for installing the one pile 12 underground (hereinafter referred to as the "simplified driving attachment") 60 (see FIG. 14). The simplified driving attachment 60 is positioned above the pile 12 to be installed underground, but is not to be installed underground in itself.

The simplified driving attachment 60 comprises a body 60A that is a circular tube having the same external form as the pile 12, and the joint 10 on at least one end of the body 60A. The fitting portions 22 of this joint 10 are formed in the direction of circumference of the body 60A. The length of the body 60A is independent of that of the pile 12 to be installed underground, and is only required to be long enough to be gripped by the chuck 32 of the press-in machine 30 described later.

Figure 14:
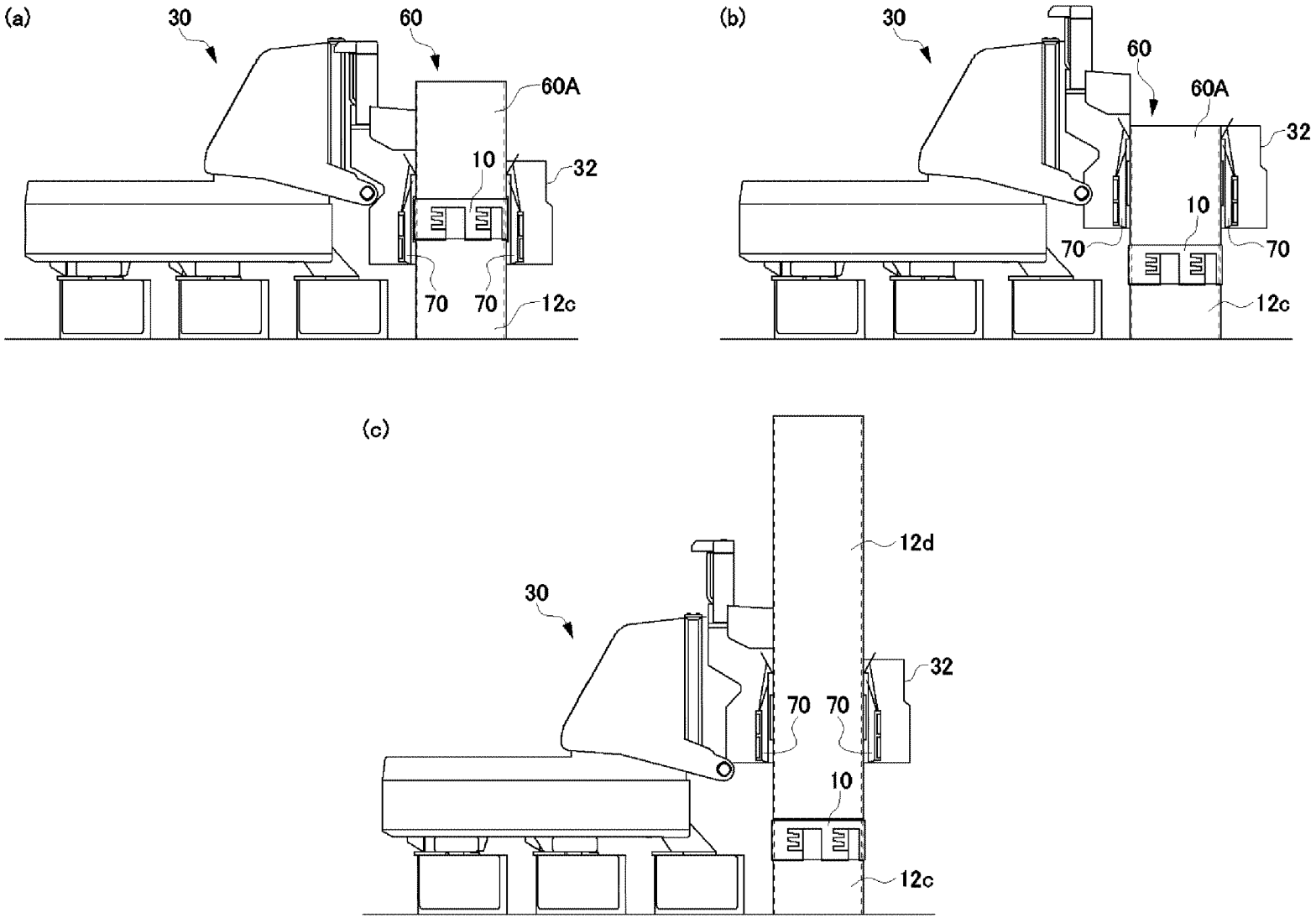
FIG. 14 shows a procedure of installing a pile underground using a press-in machine of a third embodiment, where (a) shows a state in which a lower pile and a simplified driving attachment are coupled together and the press-in machine grips them around the joint, (b) shows a state in which the lower pile and the simplified driving attachment are coupled together and the press-in machine is installing the lower pile underground, and (c) shows a state in which the lower and an upper piles are coupled together and the press-in machine is installing the lower pile deeper underground.

FIG. 14 shows a procedure of coupling the simplified driving attachment 60 to the pile 12 and installing the pile 12 underground using the press-in machine 30. The same components in FIG. 14 as in FIGS. 1 to 13 are designated by the same symbols as in FIGS. 1 to 13 and the like, and their descriptions are omitted.

The shape of the fitting portions 22 shown in FIG. 14 is the same as that shown in FIG. 13, but this is just an example, and the shape may be the same as the shape of other fitting portions 22 shown in FIGS. 1 and 11. In the following description, the pile 12 to be installed underground by using the simplified driving attachment 60 is referred to as the lower pile 12*c*, and the pile 12 to be coupled to the lower pile 12*c* is referred to as the upper pile 12*d*.

FIG. 14(*a*) shows a state in which the lower pile 12*c* and the simplified driving attachment 60 are coupled by the joint 10 and the press-in machine 30 grips an area including the joint 10. The lower pile 12*c* and the simplified driving attachment 60 are gripped by the chuck 32 after they are coupled by the joint 10.

Figure 15:
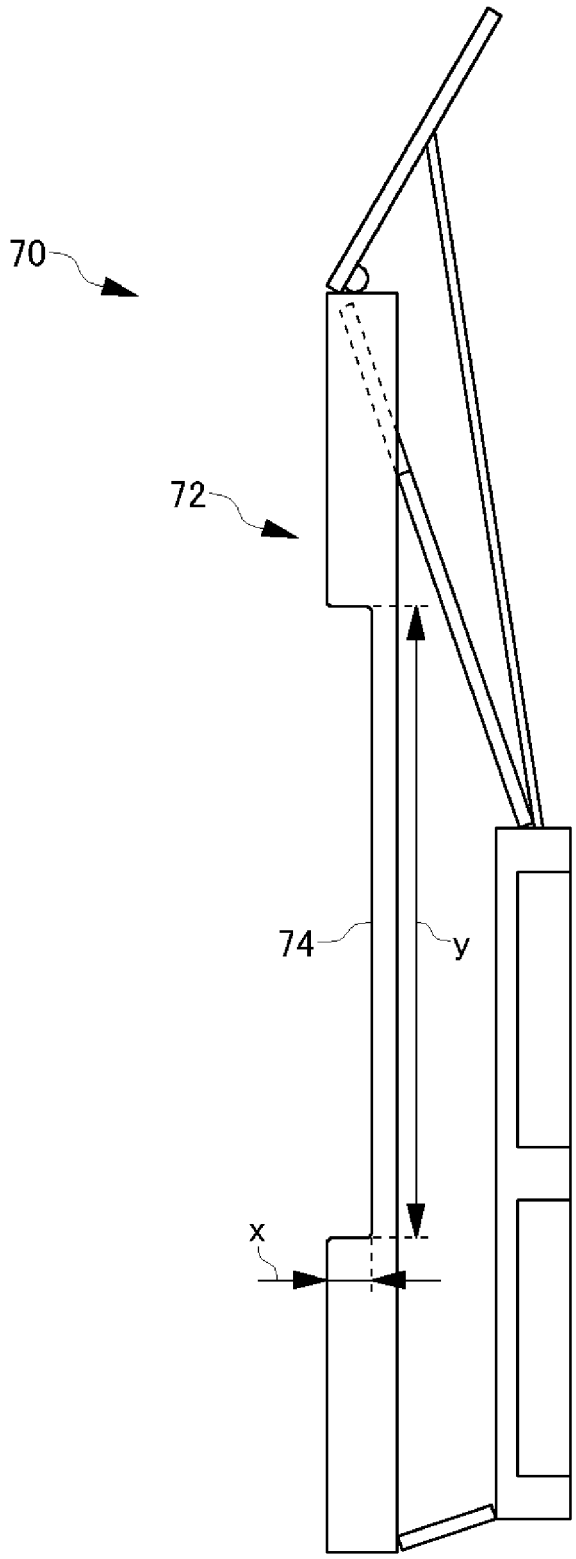
FIG. 15 is a side view of a stepped jaw comprised in a chuck of the press-in machine of the third embodiment.

FIG. 15 is a schematic side view of a jaw comprised in the chuck 32 comprised in the press-in machine 30 (hereinafter referred to as the "stepped jaw") 70. The chuck 32 presses the piles 12 from outside the outer periphery of the piles 12 with a plurality of stepped jaws 70 provided on the inner periphery of the chuck 32, and thereby grips and rotates the piles 12.

Each stepped jaw 70 is formed with a stepped shape 74 in a pressing portion 72 for pressing the piles 12. The length of the stepped shape 74 in the vertical direction, y, is formed to be equal to or slightly longer than that of the joint 10 of the simplified driving attachment 60. The depth of the stepped shape 74 in the horizontal direction, x, is formed to be equal to or slightly deeper than the thickness of the joint 10. In this manner, the pressing portion 72 is formed with a step in which the joint 10 is fitted when the chuck 32 grips the piles 12 and the like coupled by the joint 10. The portion below the stepped shape 74 of each stepped jaw 70 comes into contact with the lower pile 12*c*, and the portion above the stepped shape 74 of each stepped jaw 70 comes into contact with the body 60A of the simplified driving attachment 60.

This means that the stepped jaws 70 can grip the piles 12 without interfering with the joint 10 projecting from the outer periphery of the piles 12, and therefore they can widely grip the piles 12.

FIG. 14(*b*) shows a state in which the lower pile 12*c* and the simplified driving attachment 60 are coupled and the press-in machine 30 is installing the lower pile 12*c* underground. As shown in FIG. 14(*b*), the chuck 32 grips the body 60A of the simplified driving attachment 60 when a progress has been made in the underground installation of the lower pile 12*c*.

After this, the simplified driving attachment 60 is removed from the lower pile 12*c*. The underground-installed lower pile 12*c* is then coupled with the upper pile 12*d*. The end 12B of the upper pile 12*d* of the embodiment is joined with the joint 10, which couples the lower pile 12*c* and the upper pile 12*d* together.

FIG. 14(*c*) shows a state in which the lower pile 12*c* and the upper pile 12*d* are coupled together and the press-in machine 30 is installing the lower pile 12*c* deeper underground. As shown in FIG. 14(*c*), the press-in machine 30, gripping the upper pile 12*d* with the chuck 32, installs the lower pile 12*c* and the upper pile 12*d* underground.

Such a method of installing the lower pile 12*c* underground using the simplified driving attachment 60 allows the piles 12 to be installed underground without using a suspension apparatus. For example, if the lower pile 12*c* and the upper pile 12*d* were coupled by the joint 10 and installed underground, it would be required to use a suspension apparatus to suspend the lower pile 12*c* and upper pile 12*d* coupled by using the suspension apparatus since the total length would be long. With the use of the simplified driving attachment 60 capable of being coupled to the lower pile 12*c* by the joint 10, however, the press-in machine 30 can easily install the piles 12 underground without using any suspension apparatus.

While a description has been made for the embodiment on modes in which the simplified driving attachment 60 is equipped with the joint 10, the configuration is not limited to this, and the simplified driving attachment 60 may be provided with the keys 14 on its outer periphery instead of being equipped with the joint 10. In other words, the simplified driving attachment 60 and the lower pile 12*c* may be coupled by the joint 10 that is separate from them. In this mode, the upper pile 12*d* to be coupled to the lower pile 12*c* is provided with the keys 14 on the outer periphery, and the upper pile 12*d* is coupled to the lower pile 12*c* by the separate joint 10.

The pile 12 (upper pile 12*d*) joined with the joint 10 in advance may be coupled to the lower pile 12*c* without use of the simplified driving attachment 60, and the press-in machine 30 with the chuck 32 having the stepped jaws 70 may install the lower pile 12*c* and the upper pile 12*d* underground.

Fourth Embodiment

Figure 16:
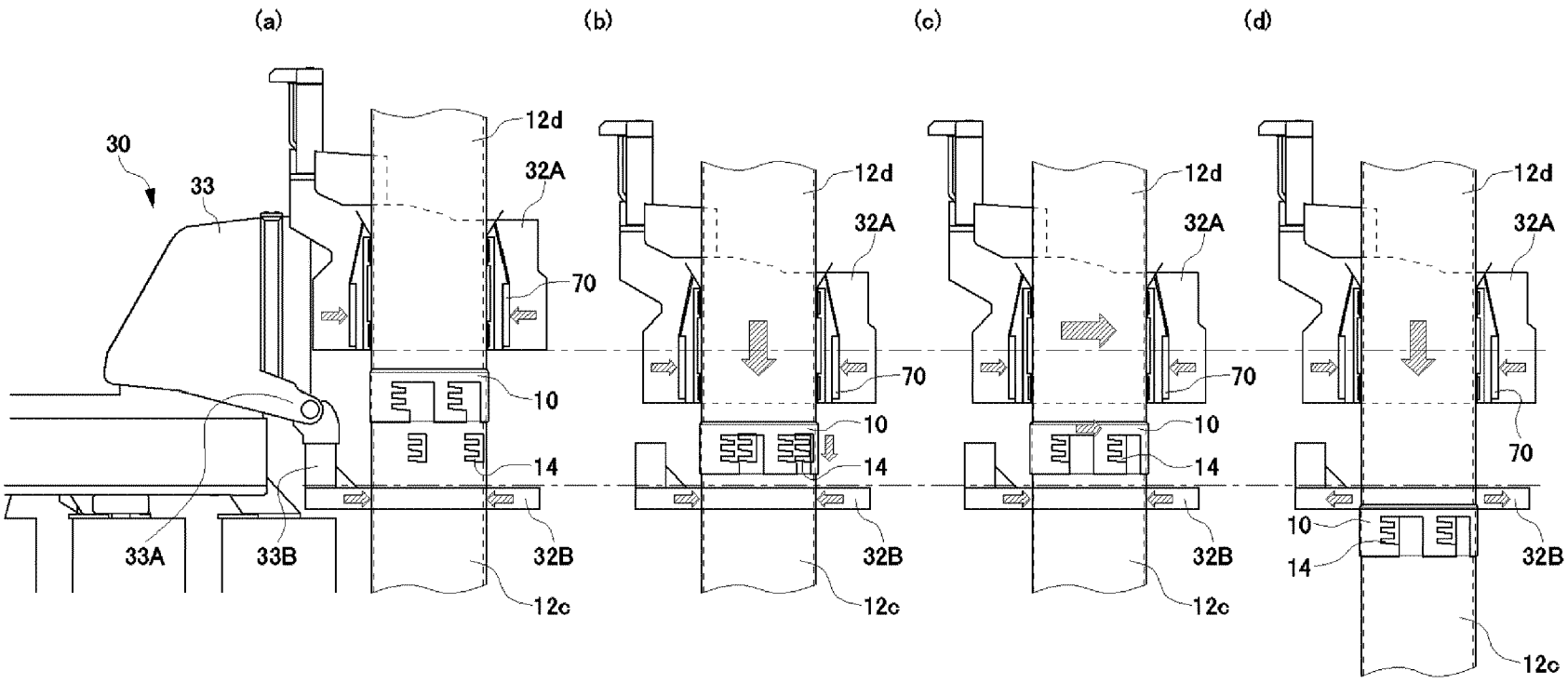
FIG. 16 shows a procedure of installing piles underground using a press-in machine of a fourth embodiment, where (a) shows a state in which a sub-chuck grips a lower pile and a main chuck grips an upper pile, (b) shows a state in which keys of the lower pile are inserted into a joint of the upper pile, (c) shows a state in which the keys of the lower pile are fitted to the joint of the upper pile by rotating the upper pile, and (d) shows a state in which the lower and upper piles are coupled together and the press-in machine is installing the lower pile deeper underground.

As shown in FIG. 16, the press-in machine 30 of this embodiment comprises a main chuck 32A and a sub-chuck 32B as the chuck 32 for gripping the piles 12. FIG. 16 shows a procedure of installing the piles 12 underground using the press-in machine 30 of the embodiment. In the embodiment, the upper pile 12*d* is joined with the joint 10 in advance and the keys 14 to be fitted to the joint 10 are joined to the lower pile 12*c*.

The main chuck 32A and the sub-chuck 32B both removably grip the piles 12. The main chuck 32A is supported so as to be capable of moving up and down with respect to a mast 33. The sub-chuck 32B is positioned below and out of the moving range of the main chuck 32A.

As shown in FIG. 16(*a*), the sub-chuck 32B is fixed to the lower end of a guide 33B extending downward from the tip of a pair of mast arms 33A provided on the mast 33, and protrudes from the lower end forward with respect to the press-in machine 30. The sub-chuck 32B is spaced from and below the main chuck 32A and is aligned coaxially with the main chuck 32A. Such a configuration allows the main chuck 32A of the press-in machine 30 of the embodiment to move up and down gripping the piles 12, and allows the sub-chuck 32B not to move up and down.

Figure 17:
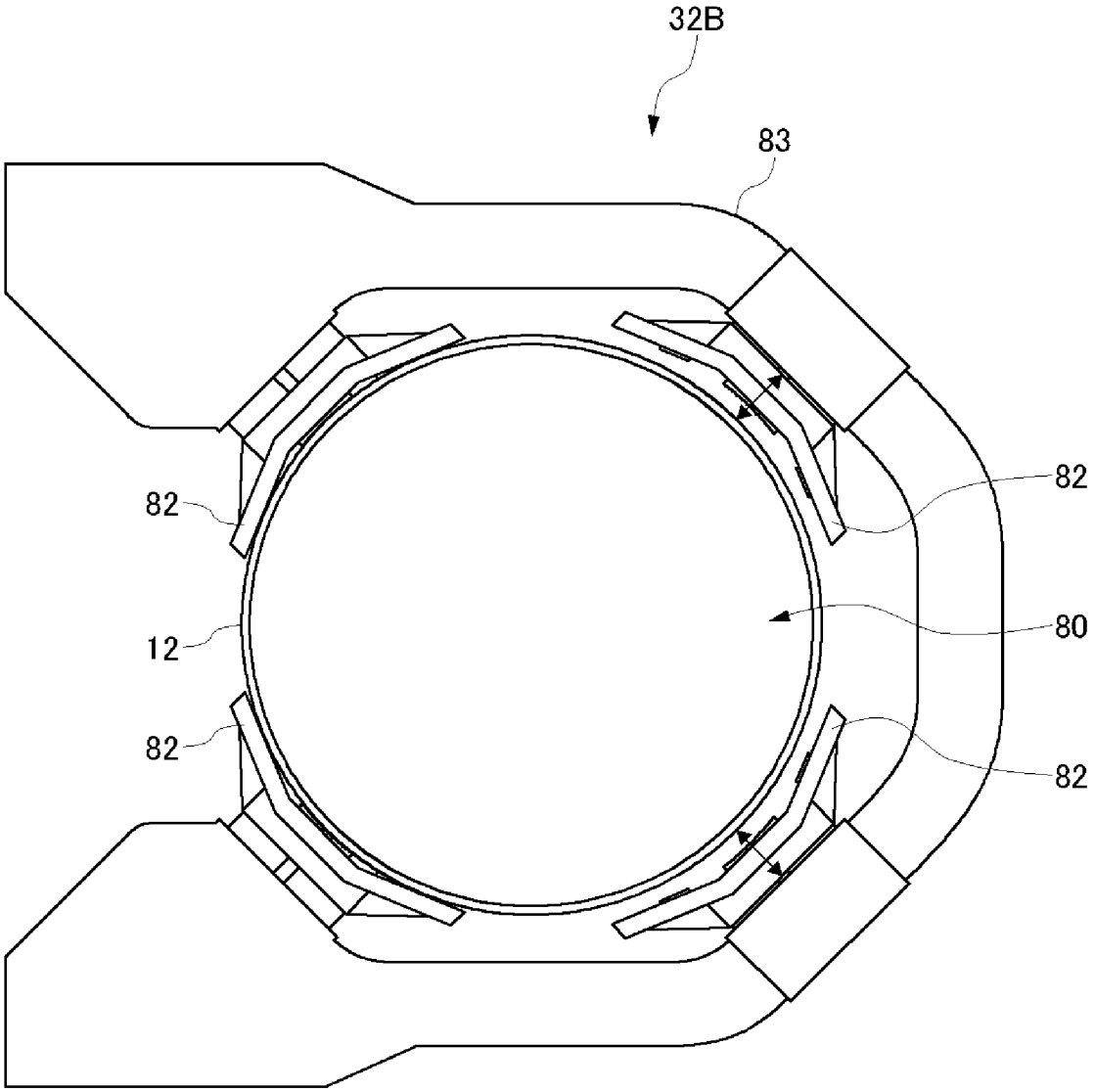
FIG. 17 is a schematic configuration diagram of the sub-chuck comprised in the press-in machine of the fourth embodiment.

FIG. 17 is a schematic configuration diagram of the sub-chuck 32B comprised in the press-in machine 30 of the embodiment.

As shown in FIG. 17, the sub-chuck 32B grips the pile 12 from outside the outer periphery at a position below the main chuck 32A in such a way that the pile 12 is fixed by the sub-chuck 32B so as to be set along the inner periphery of an insertion hole 80 through which the pile 12 is inserted into the sub-chuck 32B. An example of the sub-chuck 32B comprises a plurality of holders 82, capable of extending toward the center of the insertion hole 80, on the inner periphery of a sub-chuck frame 83. The holders 82 (four holders 82 in the example in FIG. 17) are provided in the direction of circumference of the insertion hole 80, and press the pile 12 from outside the outer periphery to grip it. Such a configuration allows the holders 82 to grip the pile 12 of any outside diameter.

The configuration of the sub-chuck 32B shown in FIG. 17 is just an example, and other configurations may be used as long as the pile 12 can be gripped. For example, the sub-chuck 32B may comprise: arc-shaped ring bands into which a ring is divided (into thirds, for example) in the direction of circumference; and a chuck cylinder for linking the ends of ring bands adjoining one another in the direction of circumference to move each ring band in a radial direction. In such a configuration, the three ring bands arranged in the direction of circumference are provided so as to form a ring, into the inner periphery of which the pile 12 is inserted, and the ring bands are moved in the radial direction to grip the pile 12.

When the lower pile 12*c* already partially installed underground and the upper pile 12*d* are to be coupled by using the press-in machine 30 via the joint 10, a bearing force and skin friction resistance are required to be acting on the lower pile 12*c* at a certain level or more. If a bearing force acting on the lower pile 12*c* is not sufficient and if the press-in machine 30 grips the upper pile 12*d* and moves it downward trying to insert the keys 14 into the inserting portions 20 of the joint 10, the lower pile 12*c* also moves down as the upper pile 12*d* moves down, and they cannot be coupled together. If skin friction resistance acting on the lower pile 12*c* is not sufficient and if the press-in machine 30 rotates the upper pile 12*d* trying to fit the keys 14 of the lower pile 12*c* to the fitting portions 22 of the joint 10, the lower pile 12*c* rotates as the upper pile 12*d* rotates, and they cannot be coupled together.

In addition, if a certain level or more of bearing force and skin friction resistance are not acting on the lower pile 12*c*, coupling of the lower pile 12*c* and the upper pile 12*d* is not reliable even if they seem to be coupled by the joint 10, and the coupling may disengage while they are pressed into the ground, or the bending strength to be generated by a proper coupling via the joint 10 may not be generated.

Given these circumstances, the underground installation method of the embodiment uses the press-in machine 30 with the sub-chuck 32B gripping the lower pile 12*c* to couple the lower pile 12*c* and the upper pile 12*d* via the joint 10.

The underground installation method of the embodiment will now be described with reference to FIG. 16. The direction of each arrow in FIG. 16 shows the direction of a force acting on the piles 12.

FIG. 16(*a*) shows a state in which the sub-chuck 32B grips the lower pile and the main chuck 32A grips the upper pile. While the main chuck 32A of the embodiment comprises the stepped jaws 70 described in the third embodiment, the stepped jaws 70 do not have to be used when the main chuck 32A does not grip the joint 10, either.

FIG. 16(*b*) shows a state in which the keys 14 of the lower pile 12*c* are inserted into the joint 10 of the upper pile 12*d* by moving the main chuck 32A downward. FIG. 16(*c*) shows a state in which the keys of the lower pile 12*c* are fitted to the joint 10 of the upper pile 12*d* by rotating the upper pile 12*d*. In FIGS. 16(*b*) and 16(*c*), the sub-chuck 32B grips the lower pile 12*c* with a sufficient force, and therefore a load and torque sufficient to couple the lower pile 12*c* and the upper pile 12*d* via the joint 10 can be applied, allowing the keys 14 and the joint 10 to be reliably fitted together.

FIG. 16(*d*) shows a state in which the lower pile 12*c* and the upper pile 12*d* are coupled together and the press-in machine 30 is installing (pressing in) the lower pile 12*c* deeper underground. The press-in machine 30 moves the main chuck 32A downward to press in the lower pile 12*c* and the upper pile 12*d* coupled by the joint 10. The sub-chuck 32B does not grip the lower pile 12*c* then, that is, does not apply any force to the lower pile 12*c*.

As described above, the underground installation method of the invention involves: moving downward and rotating the main chuck 32A with the main chuck 32A gripping the upper pile 12*d* and with the sub-chuck 32B gripping the lower pile 12*c*; and thereby coupling the upper pile 12*d* and the underground-installed lower pile 12*c* together by the joint 10. This allows the underground installation method of the invention to realize a more reliable coupling of the two piles 12.

While a description has been made for the embodiment on modes in which the upper pile 12*d* is equipped with the joint 10, the configuration is not limited to this, and the upper pile 12*d* may be provided with the keys 14 on its outer periphery instead of being equipped with the joint 10. In other words, the upper pile 12*d* and the lower pile 12*c* may be coupled by the joint 10 that is separate from them.

It is only required in the embodiment to carry out: a first step of gripping the lower pile 12*c* with the sub-chuck 32B comprised in the press-in machine 30; a second step of gripping the upper pile 12*d* with the main chuck 32A comprised in the press-in machine 30; and a third step of moving the main chuck 32A so that the ends 12B and 12B of the upper pile 12*d* and the lower pile 12*c* come into contact with each other, rotating the main chuck 32A or the sub-chuck 32B, and thereby coupling the upper pile 12*d* and the lower pile 12*c* by means of the joint 10. The upper pile 12*d* and the lower pile 12*c* may be coupled by the joint 10 before the lower pile 12*c* is installed underground.

Figure 18:
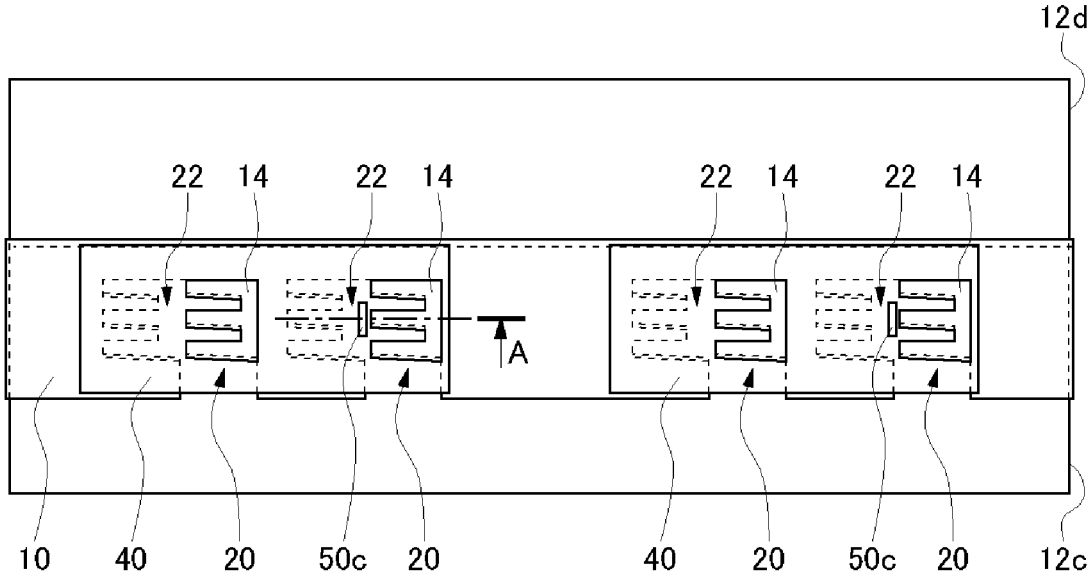
FIG. 18 shows stoppers of the fourth embodiment, where (a) shows an external view of reinforcing members and backstops, (b) shows a view on an arrow A, and (c) shows a side view illustrating how one of the keys goes through the backstop and fits to the fitting portion.
Figure 18:
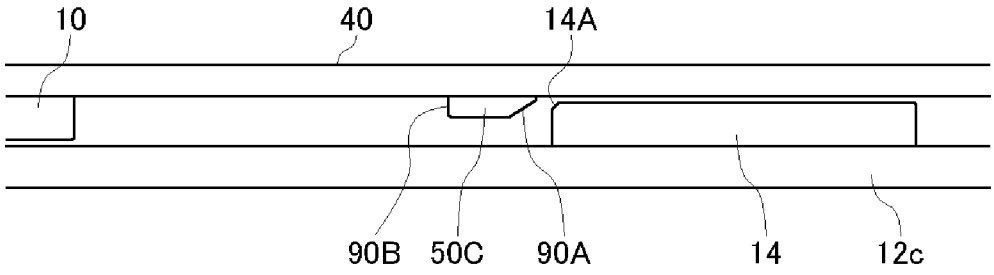
Figure 18:
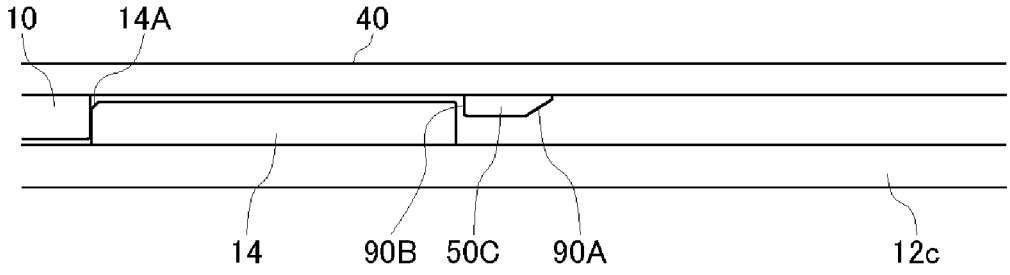

FIG. 18 is a configuration diagram of the reinforcing members 40 and backstops 50C of the embodiment. FIG. 18(*a*) is an external view (a developed view in which the joint 10 and the reinforcing members 40 are developed in the direction of the outer circumference of the piles 12), FIG. 18(*b*) shows a view on an arrow A in FIG. 18(*a*), and FIG. 18(*c*) shows a side view illustrating how one of the keys 14 goes through the backstop 50C and fits to the fitting portion 22.

In this regard, the backstops 50A and 50B described with reference to FIGS. 9 and 10 in the first embodiment are inserted into the inserting portions 20 of the joint 10 after the two piles 12 are coupled by the joint 10 provided with the reinforcing member 40.

On the other hand, each backstop 50C of the embodiment is joined in advance to the inner periphery of the reinforcing member 40 (the surface in contact with the pile 12*c*) as shown in FIG. 18(*b*). Each backstop 50C is joined in front of the fitting portion 22 of the joint 10. This means that at least one of the keys 14 inserted into the inserting portion 20 goes through the backstop 50C and fits to the fitting portion 22 as shown in FIG. 18(*c*) and is prevented from disengaging from the fitting portion 22 (hereinafter referred to as "locked") by the backstop.

An example of the backstop 50C of the embodiment is in the form of a plate, whose side facing the opposite direction of the fitting portion 22 is formed with a tapered inclined surface 90A so that the key 14 can go through the backstop 50C and fit to the joint 10. On the other hand, the side of the backstop 50C facing the direction of the fitting portion 22 is formed to be an orthogonal surface 90B perpendicular to the inner periphery of the reinforcing member 40 so that the key 14 does not disengage from the fitting portion 22. The side of the key 14 to come into contact with the inclined surface 90A of the backstop 50C is formed with a tapered inclined surface 14A, which helps the key 14 go through the backstop 50C.

Each fitting portion 22 does not have to be provided with one backstop 50C, and it is only required to join at least one backstop 50C for the fitting portions 22 formed on the joint 10. In the example in FIG. 18, two backstops 50C are joined for four fitting portions 22.

Such a backstop 50C can prevent the keys 14 fitted to the joint 10 from disengaging with a simple configuration. More specifically, the configuration of the embodiment is more simple than that shown in FIGS. 9 and 10, and is therefore lower in cost. In addition, the configuration of the embodiment allows the keys 14 to be locked in the joint 10 by the step of rotating one of the piles 12 to fit the keys 14 to the joint 10, and therefore eliminates the need for another work process for locking the keys 14.

While the invention has been described with reference to the above embodiments, the technical scope of the invention is not limited to the scope provided by the embodiments. Various modifications or improvements can be made to the embodiments without departing from the gist of the invention, and those added with the modifications or improvements are also included in the technical scope of the invention.

While a description has been made for the above embodiments on modes in which a tapered shape and a wedge shape are formed on each fitting portion 22, the invention is not limited to this, and each fitting portion 22 may be formed only with a tapered shape, or only with a wedge shape. In other words, each fitting portion 22 is only required to be formed with at least a tapered shape or a wedge shape.

While a description has been made for the above embodiments on modes in which the body 16 of the joint 10 covers the outer peripheries 12A of the piles 12, the invention is not limited to this, and the body 16 of the joint 10 may be formed to be set along the inner peripheries of the piles 12. The keys 14 are provided on the inner periphery of each pile 12 in this mode.

DESCRIPTION OF THE SYMBOLS

10: Joint (Pile joint)
12: Pile
14: Key (Projection)
16: Body
22: Fitting portion
40: Reinforcing member
50A: Backstop (Retaining member)
50B: Backstop (Retaining member)
50C: Backstop (Retaining member)

The invention claimed is:

1. A pile joint for coupling two piles, the pile joint comprising:
   - a tubular body into which each pile provided with a projection on a periphery thereof is inserted through an end of the body; and
   - a fitting portion formed on the body so as to be fitted to the projection by the insertion and rotation of the pile, wherein
   - the projection has a first wedge part,
   - the fitting portion is formed with:
     - a first shape having a tapered surface that is inclined so as to become distant from the end of the body as the tapered surface extends in a direction of the rotation of the pile; and
     - a second shape having a second wedge part that is fitted between the first wedge part and the pile, and
   - the second shape is formed in a direction intersecting a longitudinal direction of the pile.

2. The pile joint according to claim 1, wherein the fitting portion is formed so that the second shape is formed on the surface forming the first shape.

3. The pile joint according to claim 1,
   - wherein each pile is provided with a plurality of projections, each identical to the projection, spaced at unequal angles in a direction of circumference, and
   - wherein the body is formed with a plurality of fitting portions, each identical to the fitting portion, corresponding to the projections.

4. The pile joint according to claim 1, wherein the body is provided with a reinforcing member for covering at least each fitting portion.

5. The pile joint according to claim 4, comprising a retaining member to be fixed to the reinforcing member and prevent each projection from disengaging from the fitting portion.

6. The pile joint according to claim 4, wherein the reinforcing member is formed with a hole for checking that each projection is inserted into the fitting portion.

7. The pile joint according to claim 1, wherein each fitting portion is formed with a plurality of first shapes, each identical to the first shape, or a plurality of second shapes, each identical to the second shape, arranged in a direction of an axis of the piles.

8. The pile joint according to claim 1, wherein the first shape and the second shape allow the pile to unite with another pile.

9. A pile coupling structure comprising:

a pile provided with a projection on a periphery thereof; and a pile joint that has a tubular body into which the pile is inserted through an end of the body and which covers the periphery of the pile and comprises a fitting portion to be fitted to the projection by the insertion and rotation of the pile, the projection having a first wedge part, the fitting portion being formed with: a first shape having a tapered surface that is inclined so as to become distant from the end of the body as the tapered surface extends in a direction of the rotation of the pile; and a second shape having a second wedge part that is fitted between the first wedge part and the pile.

10. The pile coupling structure according to claim 9, wherein the projection has a planar shape, an inside of which is cut out.

11. The pile coupling structure according to claim 9, wherein one of two piles that are each identical to the pile and are to be coupled together by the pile joint is to be installed underground, and wherein the other pile is to be used in an auxiliary manner for installing the one pile underground and is positioned above the one pile.

12. A pile coupling method for coupling two piles by means of a pile joint that has a tubular body into which each pile provided with a projection on a periphery thereof is inserted through an end of the body and which covers the periphery of the pile and comprises a fitting portion to be fitted to the projection by the insertion and rotation of the pile, the projection having a first wedge part, the fitting portion being formed with: a first shape having a tapered surface that is inclined so as to become distant from the end of the body as the tapered surface extends in a direction of the rotation of the pile; and a second shape having a second wedge part that is fitted between the first wedge part and the pile, wherein the pile coupling method has:

a first step of installing one of the two piles underground; and a second step of standing the other pile above the underground-installed pile and rotating the other pile so that the two piles are fitted together by the pile joint.

13. A pile coupling method for coupling a first pile and a second pile by means of a pile joint that has a tubular body into which each pile provided with a projection on a periphery thereof is inserted through an end of the body and which covers the periphery of the pile and comprises a fitting portion to be fitted to the projection by the insertion and rotation of the pile, the projection having a first wedge part, the fitting portion being formed with: a first shape having a tapered surface that is inclined so as to become distant from the end of the body as the tapered surface extends in a direction of the rotation of the pile; and a second shape having a second wedge part that is fitted between the first wedge part and the pile, wherein the pile coupling method has:

a first step of gripping the second pile with a second gripper comprised in a press-in machine;

a second step of gripping the first pile with a first gripper comprised in the press-in machine; and a third step of moving the first gripper so that ends of the first and second piles come into contact with each other, rotating the first or second gripper, and thereby coupling the first and second piles by means of the pile joint.

* * * * *